US010649382B2

(12) United States Patent
Shinnae et al.

(10) Patent No.: US 10,649,382 B2
(45) Date of Patent: May 12, 2020

(54) CONTROL APPARATUS FOR CONTROLLING SYSTEM INCLUDING IMAGE FORMING APPARATUS AND SHEET DISCHARGE APPARATUS

(71) Applicant: CANON KABUSHIKI KAISHA, Tokyo (JP)

(72) Inventors: Toru Shinnae, Kashiwa (JP); Jerome Guermont, Dusseldorf (DE); Nobuaki Miyahara, Moriya (JP); Ryo Fujita, Tokyo (JP); Yoshitaka Oba, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/982,621

(22) Filed: May 17, 2018

(65) Prior Publication Data

US 2018/0335741 A1 Nov. 22, 2018

(30) Foreign Application Priority Data

May 22, 2017 (JP) ..... 2017-101138

(51) Int. Cl.
*G03G 15/00* (2006.01)
*B65H 29/00* (2006.01)
*B65H 33/00* (2006.01)

(52) U.S. Cl.
CPC ..... *G03G 15/5091* (2013.01); *B65H 29/00* (2013.01); *B65H 33/00* (2013.01); *G03G 15/6529* (2013.01); *G03G 15/6538* (2013.01); *B65H 2220/02* (2013.01)

(58) Field of Classification Search
None
See application file for complete search history.

(56) References Cited

U.S. PATENT DOCUMENTS 8,055,183 B2 11/2011 Inenaga
8,177,222 B2 5/2012 Yaginuma
9,242,829 B2 1/2016 Miyajima
(Continued)

FOREIGN PATENT DOCUMENTS

CN 101135959 A 3/2008
CN 101867719 A 10/2010
(Continued)

*Primary Examiner* — Fan Zhang
(74) *Attorney, Agent, or Firm* — Canon U.S.A., Inc. IP Division

(57) ABSTRACT

A control apparatus includes a processor and a memory to control a system having an image forming apparatus and a sheet discharge apparatus. Executing a memory store program causes the control apparatus to receive configuration information of the system and generate a system configuration image, receive stacking state information and generate a sheet bundle image, display a screen, receive job identification information of an image forming job of sheets to be picked up, and display a thumbnail image. The stacking state information includes a stacking amount of sheets stacked on a sheet stacking tray. The sheet bundle image represents the sheets stacked on a sheet stacking tray based on the stacking state information. The system configuration image and the sheet bundle image are combined in the screen. The thumbnail image is based on receiving the job identification information.

12 Claims, 17 Drawing Sheets

(56) References Cited

U.S. PATENT DOCUMENTS

| | | | | |
|---|---|---|---|---|
| 2001/0054793 | A1 | 12/2001 | Nakahira | |
| 2005/0017426 | A1 | 1/2005 | Hirata | |
| 2006/0082818 | A1 | 4/2006 | Kasamatsu | |
| 2006/0261543 | A1 | 11/2006 | Miyake | |
| 2006/0285869 | A1 | 12/2006 | Kushida | |
| 2008/0055637 | A1 | 3/2008 | Hatakeyama | |
| 2008/0178120 | A1* | 7/2008 | Yamamoto | G06F 16/50 715/838 |
| 2009/0041482 | A1 | 2/2009 | Inenaga | |
| 2010/0251170 | A1* | 9/2010 | Louch | G06F 16/95 715/810 |
| 2011/0075195 | A1 | 3/2011 | Cain | |
| 2011/0157642 | A1 | 6/2011 | Nemoto | |
| 2011/0211888 | A1* | 9/2011 | Fujinaga | B41J 13/0009 399/403 |
| 2013/0334771 | A1 | 12/2013 | Igarashi | |
| 2015/0098101 | A1 | 4/2015 | Asakawa | |
| 2016/0031669 | A1 | 2/2016 | Mori | |
| 2016/0052320 | A1 | 2/2016 | Mutsuno | |
| 2016/0162222 | A1* | 6/2016 | De Boer | G06F 3/1207 358/1.15 |

FOREIGN PATENT DOCUMENTS

| | | | |
|---|---|---|---|
| CN | 101873430 | A | 10/2010 |
| CN | 102166896 | A | 8/2011 |
| CN | 102189775 | A | 9/2011 |
| CN | 102207950 | A | 10/2011 |
| CN | 102365635 | A | 2/2012 |
| CN | 103508245 | A | 1/2014 |
| CN | 103863876 | A | 6/2014 |
| JP | 2002362821 | * | 12/2002 |
| JP | 2009137186 | A | 6/2009 |
| JP | 2013146898 | A | 8/2013 |
| JP | 2014098875 | A | 5/2014 |

* cited by examiner

132

501

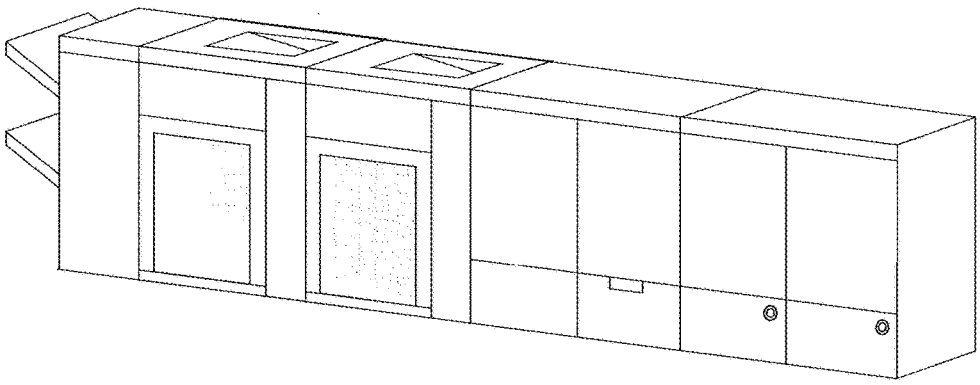

521 522 523

| STACKING TRAY | SHEET DISCHARGE APPARATUS | TRAY TYPE | TRAY POSITION COORDINATES |
|---|---|---|---|
| TRAY #1 | LARGE-CAPACITY STACKER (320) | TOP TRAY | (396、102) |
| TRAY #2 | LARGE-CAPACITY STACKER (320) | LIFT TRAY | (376、177) |
| TRAY #3 | LARGE-CAPACITY STACKER (320) | EJECTION TRAY | (347、277) |
| TRAY #4 | LARGE-CAPACITY STACKER (340) | TOP TRAY | (257、85) |
| TRAY #5 | LARGE-CAPACITY STACKER (340) | LIFT TRAY | (237、160) |
| TRAY #6 | LARGE-CAPACITY STACKER (340) | EJECTION TRAY | (208、260) |
| TRAY #7 | FINISHER (360) | UPPER TRAY | (92、82) |
| TRAY #8 | FINISHER (360) | LOWER TRAY | (92、155) |

FIG. 5

PROCESSED-JOB LIST

| JOB ID | JOB NAME | PROCESSING DATE/TIME | NUMBER OF PAGES | NUMBER OF BUNDLES | USED SHEET |
|---|---|---|---|---|---|
| 00000001 | IMAGE FORMING JOB #1 | 2011/08/13 13:52:21 JST | 5 | 100 | ABC PAPER C081 |
| 00000002 | IMAGE FORMING JOB #2 | 2011/08/13 14:09:02 JST | 20 | 5 | ABC PAPER C082 |
| 00000003 | IMAGE FORMING JOB #3 | 2011/08/21 09:11:43 JST | 20 | 30 | ABC PAPER C081 |
| 00000004 | IMAGE FORMING JOB #4 | 2011/08/22 10:34:28 JST | 60 | 500 | DEF PAPER /PLAIN PAPER |
| 00000005 | IMAGE FORMING JOB #5 | 2011/08/22 16:46:27 JST | 100 | 1 | XYZ PAPER/PLAIN PAPER |
| | | | | | |

FIG. 13A

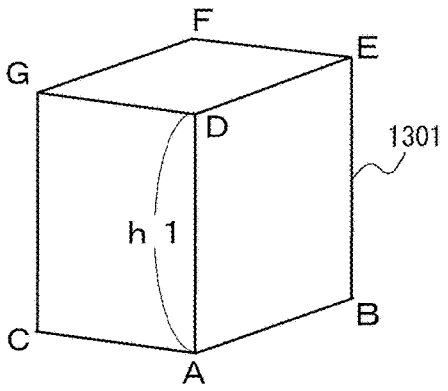

FIG. 13B

1302

| | COORDINATE POSITION |
|---|---|
| A | TRAY POSITION COORDINATES(x, y) |
| B | x+33 , y-13 |
| C | x-35 , y-5 |
| D | x, y-h1 |
| E | x+33 , y-h1-13 |
| F | x-5 , y-h1-17 |
| G | x-35 , y-h1-5 |

FIG. 13C

1303

```
<path stroke="black" stroke-width="1" fill="white" fill-opacity="0.7" d="M x (y-h1) L (x+33) (y-h1-13) L (x-5) (y-h1-17) L (x-35) (y-h1-5) Z"/>
<path stroke="black" stroke-width="1" fill="white" fill-opacity="0.7" d="M x (y-h1) L (x-35) (y-h1-5) L (x-35) (y-5) L x y Z"/>
<path stroke="black" stroke-width="1" fill="white" fill-opacity="0.7" d="M x (y-h1) L x y L (x+33) (y-13) L (x+33) (y-h1-13) Z"/>
```

FIG. 14A

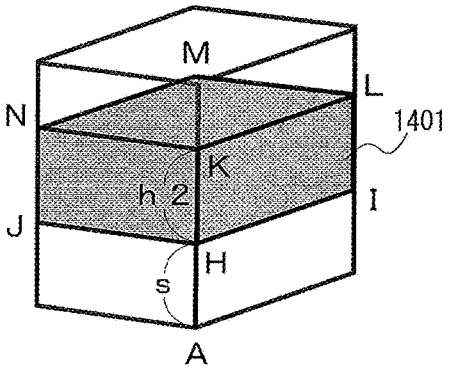

FIG. 14B

1402

| | COORDINATE POSITION |
|---|---|
| A | TRAY POSITION COORDINATES (x, y) |
| H | x , y-s |
| I | x+33 , y-s-13 |
| J | x-35 , y-s-5 |
| K | x, y-s-h2 |
| L | x+33 , y-s-h2-13 |
| M | x-5 , y-s-h2-17 |
| N | x-35 , y-s-h2-5 |

FIG. 14C

1403

```
<path stroke="black" stroke-width="1" fill="gray" fill-opacity="0.7" d="M x (y-s-h2) L (x+33) (y-s-h2-13) L (x-5) (y-s-h2-17) L (x-35) (y-s-h2-5) Z"/>
<path stroke="black" stroke-width="1" fill="gray" fill-opacity="0.7" d="M x (y-s-h2) L (x-35) (y-s-h2-5) L (x-35) (y-s-5) L x (y-s) Z"/>
<path stroke="black" stroke-width="1" fill="gray" fill-opacity="0.7" d="M x (y-s-h2) L x (y-s) L (x+33) (y-s-13) L (x+33) (y-s-h2-13) Z"/>
```

FIG. 15A
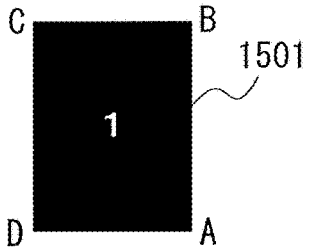
FIG. 15B
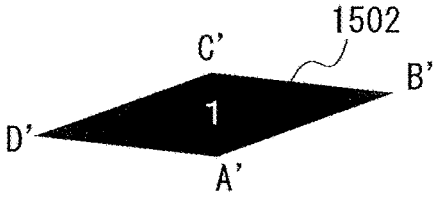
FIG. 15C
1503
| | COORDINATE POSITION |
|---|---|
| TRAY POSITION INFORMATION | x, y |
| A | (m , n) |
| B | (m , 0) |
| C | (0 , 0) |
| D | (0 , n) |
| A' | K (x, y-s-h2) |
| B' | L (x+33 , y-s-h2-13) |
| C' | M (x-5 , y-s-h2-17) |
| D' | N (x-35 , y-s-h2-5) |
FIG. 16A
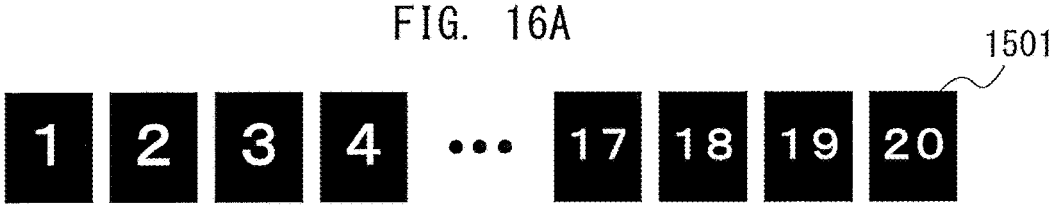
FIG. 16B
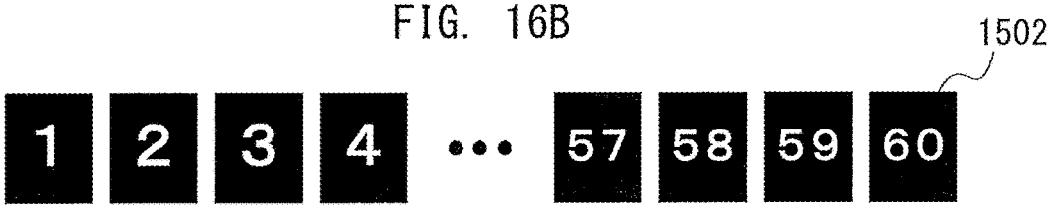

PROCESSED-JOB LIST

| JOB ID | JOB NAME | PROCESSING DATE/TIME | NUMBER OF PAGES | NUMBER OF BUNDLES | USED PAPER |
|---|---|---|---|---|---|
| 00000001 | IMAGE FORMING JOB #1 | 2011/08/13 13:52:21 JST | 5 | 100 | ABC PAPER C081 |
| 00000002 | IMAGE FORMING JOB #2 | 2011/08/13 14:09:02 JST | 20 | 5 | ABC PAPER C082 |
| 00000003 | IMAGE FORMING JOB #3 | 2011/08/21 09:11:43 JST | 20 | 30 | ABC PAPER C081 |
| 00000004 | IMAGE FORMING JOB #4 | 2011/08/22 10:34:28 JST | 60 | 500 | DEF PAPER/PLAIN PAPER |
| 00000005 | IMAGE FORMING JOB #5 | 2011/08/22 16:46:27 JST | 100 | 1 | XYZ PAPER/PLAIN PAPER |
| | | | | | |

PROCESSED-JOB LIST

| JOB ID | JOB NAME | PROCESSING DATE/TIME | NUMBER OF PAGES | NUMBER OF BUNDLES | USED PAPER |
|---|---|---|---|---|---|
| 00000001 | IMAGE FORMING JOB #1 | 2011/08/13 13:52:21 JST | 5 | 100 | ABC PAPER C081 |
| 00000002 | IMAGE FORMING JOB #2 | 2011/08/13 14:09:02 JST | 20 | 5 | ABC PAPER C082 |
| 00000003 | IMAGE FORMING JOB #3 | 2011/08/21 09:11:43 JST | 20 | 30 | ABC PAPER C081 |
| 00000004 | IMAGE FORMING JOB #4 | 2011/08/22 10:34:28 JST | 60 | 500 | DEF PAPER/PLAIN PAPER |
| 00000005 | IMAGE FORMING JOB #5 | 2011/08/22 16:46:27 JST | 100 | 1 | XYZ PAPER/PLAIN PAPER |
| | | | | | |

CONTROL APPARATUS FOR CONTROLLING SYSTEM INCLUDING IMAGE FORMING APPARATUS AND SHEET DISCHARGE APPARATUS

BACKGROUND OF THE INVENTION

Field of the Invention

The present disclosure relates to an image forming system including an image forming apparatus configured to form an image on a sheet and a sheet discharge apparatus configured to discharge the sheet having the image formed thereon.

Description of the Related Art

There are known service forms for image formation called print on demand (POD) and production printing. In such service forms, small-lot and high-variety printing orders are received from customers. Then, images are formed using an image forming apparatus operating at high speed to deliver the orders. At this time, images are rapidly formed onto a large amount of sheets (sheet-like media, the same holds true in the following), and the sheets are discharged. A large-capacity stacker is prepared at a discharge destination.

The large-capacity stacker of this type stacks several thousands of sheets at one time. A plurality of large-capacity stackers may be mounted so that, even when one large-capacity stacker is full, image formation can be continued by automatically switching a discharge destination to another large-capacity stacker. In this case, sheets having images formed thereon and corresponding to one image forming job are discharged to a plurality of discharge destinations in a divided manner. In the following description, the "sheet having the image formed thereon" is referred to as "sheet" in some cases.

Meanwhile, an operator collects the discharged sheets having images formed thereon to perform the next operation. However, it is not easy to identify a position of a sheet corresponding to a desired image forming job from a large amount of sheets discharged to a plurality of sheet discharge destinations. In order to address this issue, in Japanese Patent Application Laid-open No. 2013-146898, in order to allow an operator to check the sheet discharge destination for each image forming job, information on the large-capacity stacker corresponding to the discharge destination is displayed on a display device. In this manner, the operator can check the sheet discharge destination corresponding to each image forming job, and reliably collect the sheets corresponding to a processed job.

In the technology disclosed in Japanese Patent Application Laid-open No. 2013-146898, information on the sheet discharge apparatus to which no sheets a discharged is not displayed. Therefore, in a configuration in which a plurality of sheet discharge apparatus are mounted, it is difficult to recognize which stacking portion of which sheet discharge apparatus the discharge destination corresponds to. In the technology disclosed in Japanese Patent Application Laid-open No. 2013-146898, further, when there are a plurality of image forming jobs, only a discharge destination of the sheet corresponding to selected one of the image forming jobs is displayed. Therefore, the current sheet stacking state at the discharge destination cannot be correctly recognized. Further, also when the sheets are collected, both of sheets corresponding to the image forming job, which have been collected, and sheets corresponding to the image forming job, which have not been collected, are displayed. Therefore, it takes time to identify the stacking state of sheets corresponding to the image forming job, which is to be actually collected.

SUMMARY OF THE INVENTION

The present disclosure provides a control apparatus for controlling a system including an image forming apparatus that allows recognition of a stacking portion for removable sheets corresponding to an image forming job. In an example, an image region in which an entire arrangement mode of an image forming apparatus and a sheet discharge apparatus is displayed, and a list region in which processed jobs are listed are displayed. In the image region, sheet bundle images representing sheet bundles corresponding to respective processed jobs are mapped and displayed at positions of sheet discharge trays corresponding thereto. When a certain processed job is designated in the list region, a sheet serving as a border of image formation corresponding to the designated processed job is displayed as a thumbnail image of the image formed on the sheet.

According to an aspect of e present invention, a control apparatus to control a system having an image forming apparatus to form an image onto a sheet based on an image forming job, and a sheet discharge apparatus to discharge the sheet to a sheet stacking tray includes a processor and a memory storing a program which, when executed by the processor, causes the control apparatus to: receive configuration information of the system and generate a system configuration image based on the configuration information, receive stacking state information including a stacking amount of sheets stacked on the sheet stacking tray and generate a sheet bundle image representing the sheets stacked on a sheet stacking tray based on the stacking state information, display, on a display, a screen in which the system configuration image and the sheet bundle image are combined, receive job identification information of an image forming job of sheets to be picked up, and display, based on receiving the job identification information, a thumbnail image of a last sheet corresponding to the image forming job.

Further features of the present disclosure will become apparent from the following description of embodiments (with reference to the attached drawings).

BRIEF DESCRIPTION OF THE DRAWINGS

FIG. 5 is a diagram of apparatus display information.

FIG. 13A, FIG. 13B, and FIG. 13C are explanatory illustrations of an outline of rendering of a sheet bundle.

FIG. 14A, FIG. 14B, and FIG. 14C are explanatory illustrations of another outline of the rendering of the sheet bundle.

FIG. 15A, FIG. 15B, and FIG. 15C are explanatory illustrations of an outline of rendering of a thumbnail image.

FIG. 16A and FIG. 16B are diagrams for illustrating image data being a basis of the thumbnail image.

DESCRIPTION OF THE EMBODIMENTS

First Embodiment

Figure 1:
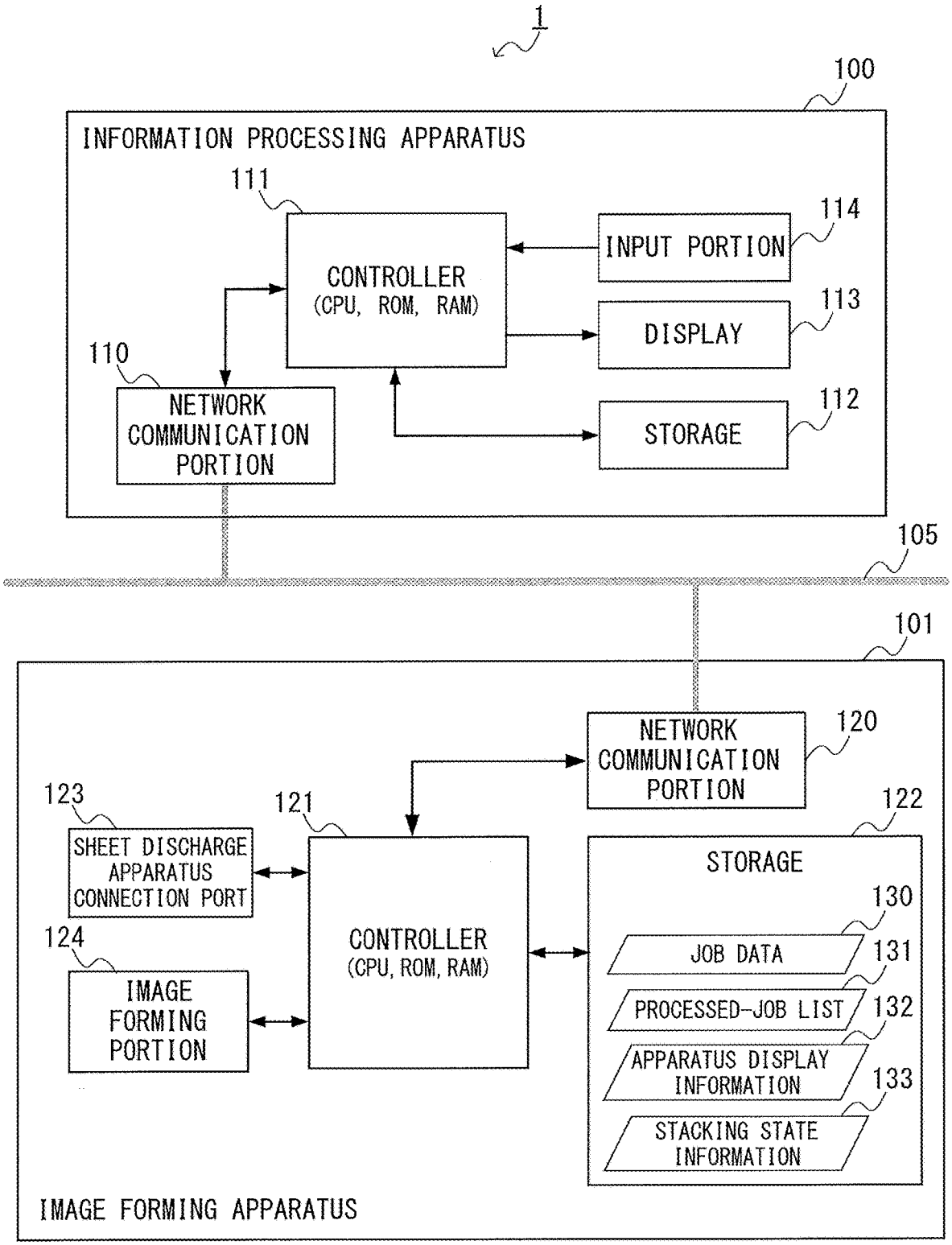
FIG. 1 is a configuration diagram of an image forming system.

FIG. 1 is a diagram for illustrating a schematic configuration example of an image forming system to which the present disclosure is applied. An image forming system 1, as an example of a system, includes an information processing apparatus 100 and an image forming apparatus 101, which are mounted to a communication network 105. The first embodiment represents an example in which one information processing apparatus 100 and one image forming apparatus 101 are provided, but a plurality of information processing apparatus 100 and a plurality of image forming apparatus 101 may be provided. The communication network 105 is a local area network (LAN). As the communication network 105, a wide area network (WAN), a combination of the LAN and the WAN, or a wired network may be employed instead.

The information processing apparatus 100 includes a network communication portion 110, a controller 111, a storage 112, a display 113, and an input portion 114. The network communication portion 110 is a communication device for controlling the communication performed with the communication network 105. The storage 112 is a storage for storing large-capacity data in a short or long term. The display 113 is a display device for performing various types of display for an operator. In the first embodiment, the display 113 displays, for example, a system configuration image and a sheet bundle image to be described later. The input portion 114 receives various instructions from the operator and a range designation, for example. Further, the input portion 114 also functions as a job input device for receiving input of an image forming job, a data input device for inputting image data or the like, and a designation input device for receiving designation input of a processed job. The processed job refers to an image forming job for which image formation to the sheet has been finished as described later. When the display 113 is constructed of a touch panel, various instructions from the operator, a range designation, and designation of a job can also be input from the display 113.

The controller (control apparatus) 111 is one type of computer including a central processing unit (CPU), a read only memory (ROM), and a random access memory (RAM). The CPU executes a computer program for terminal control to form various functions for the information processing apparatus 100. This operation is described later. The ROM stores the above-mentioned computer program and the like. The RAM is a work memory for the CPU.

The image forming apparatus 101 includes a network communication portion 120, a controller 121, a storage 122, a sheet discharge apparatus connection port 123, and an image forming portion 124. The network communication portion 120 is a communication device for controlling the communication performed with the communication network 105. The storage 122 is a storage for storing large-capacity data in a short or long term. The sheet discharge apparatus connection port 123 is a connecting device for connecting the sheet discharge apparatus. The image forming portion 124 is an image forming apparatus for forming an image onto a sheet for each input image forming job. The controller 121 is a computer including a CPU, a ROM, and a RAM, or may be an embedded computer. The CPU executes a computer program for image formation control to form various functions for the image forming apparatus 101 and operate as a control device for controlling an operation of each of the functions. This operation is described later. The ROM stores the above-mentioned computer program for image formation control. The RAM is a work memory for the CPU.

The storage 122 of the image forming apparatus 101 stores job data 130, a processed-job list 131, apparatus display information 132, and stacking state information 133. Examples of the job data 130 include image data and instruction data representing the details of the input image forming job, data obtained after execution of the image forming job, and data obtained during the process of execution of the image forming job. The processed-job list 131 is a list listing the image forming jobs executed by the image forming apparatus 101 as the processed jobs. The processed-job list 131 stores, for example, job attributes such as identification information (job ID) for identifying the image forming job, a job name, the number of pages, the number of bundles, and a sheet in association with one another.

The apparatus display information 132 is one type of first information representing the entire arrangement mode of image forming apparatus (sheet discharge apparatus) and a plurality of sheet stacking device, and is referred to when a system configuration image to be described later is generated. In this example, the image forming apparatus corresponds to the image forming apparatus 101, and the sheet stacking device corresponds to the sheet discharge apparatus to be described later. Therefore, information representing the outer appearance, structure, and size of each of the image forming apparatus 101 and the sheet discharge apparatus, and the outer appearance, structure, and size as a whole during connecting is referred to as the apparatus display information 132. For example, the apparatus display information 132 represents a mode in which, when three sheet discharge apparatus are mounted to the image foxing apparatus 101 in a daisy-chain configuration, the sheet discharge apparatus adjacent to the image forming apparatus 101 is arranged as the first sheet discharge apparatus, and then the second sheet discharge apparatus and the third sheet discharge apparatus are sequentially arranged. The apparatus display information 132 is determined based on the combination of the mounted sheet discharge apparatus. The sheet discharge apparatus is arranged so as to be replaceable with other sheet discharge apparatus. Therefore, the apparatus display information 132 is updated to new information as appropriate.

The stacking state information 133 is one type of second information representing a stacking state of sheets having images formed thereon in each sheet stacking device, and is referred to when a sheet bundle image to be described later is generated. The sheet having an image formed thereon is hereinafter referred to as "sheet". Further, a group of two sheets or more is hereinafter referred to as "sheet bundle" in some cases. The stacking state information 133 includes information representing the shape and the size of the sheet or the sheet bundle, which is required for generating the sheet bundle image to be described later. This information may be updated in real time every time a detection result of a stacking state detected by detection device to be described later is acquired. The "stacking state" herein refers to presence or absence of a sheet at a sheet stacking portion (including the change in portion at which the sheets are stacked), and the transition of the outer shape and the size of the sheet and the sheet stacking height, that is, refers to all the changes in sheet state until the sheets are collected by an ejecting operation to be described later.

Next, the sheet discharge apparatus to be mounted to the sheet discharge apparatus connection port 123 of the image forming apparatus 101 are described. The sheet discharge apparatus refers to a large-capacity stacker and a finisher, and is an apparatus capable of being freely combined or replaced afterwards. Those sheet discharge apparatus operate as a sheet stacking device capable of stacking and collecting the sheets for each image forming job. That is, each sheet discharge apparatus stacks sheets corresponding to a processed job onto the sheet stacking portion to achieve a sheet bundle of each image forming job.

Figure 2:
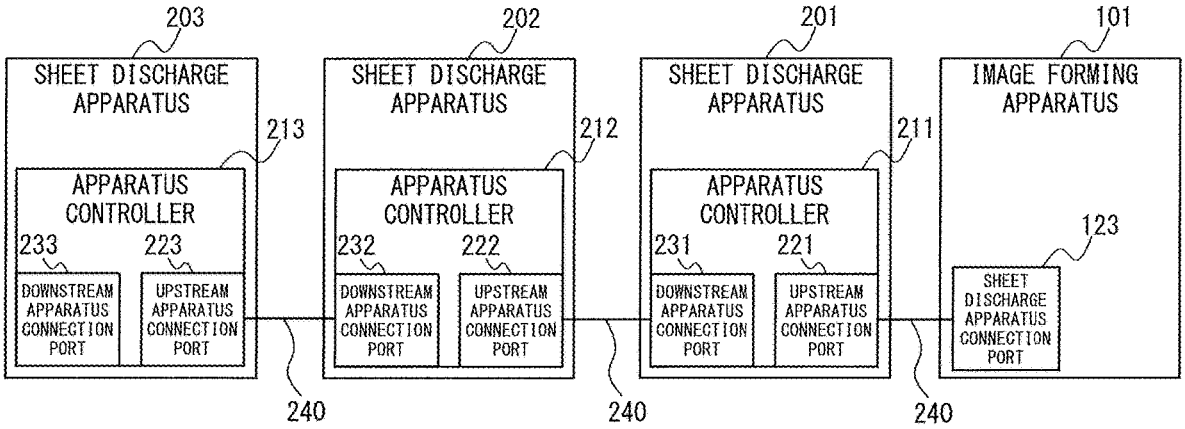
FIG. 2 is a schematic diagram for illustrating a state in which sheet discharge apparatus are connected to an image forming apparatus.

FIG. 2 is a schematic diagram for illustrating a connecting example in a case in which three sheet discharge apparatus 201 to 203 are mounted to the sheet discharge apparatus connection port 123 in a daisy-chain configuration. The sheet discharge apparatus 201 to 203 include apparatus controllers 211, 212, and 213, respectively, for controlling the operation of each own apparatus. The apparatus controllers 211, 212, and 213 include upstream apparatus connection ports 221, 222, and 223 and downstream apparatus connection ports 231, 232, and 233, respectively. Each of the upstream apparatus connection ports 221, 222, and 223 is a port for connecting to an apparatus on the upstream of the own apparatus via a communication cable 240. Each of the downstream apparatus connection ports 231, 232, and 233 is a port for connecting to an apparatus on the downstream of the own apparatus via the communication cable 240. In this manner, the image forming apparatus 101 and the three sheet discharge apparatus 201, 202, and 203 can communicate with each other. The third sheet discharge apparatus 203 may be omitted, or another apparatus that can communicate with the image forming apparatus 101 may be mounted on the downstream of the third sheet discharge apparatus 203.

Figure 3:
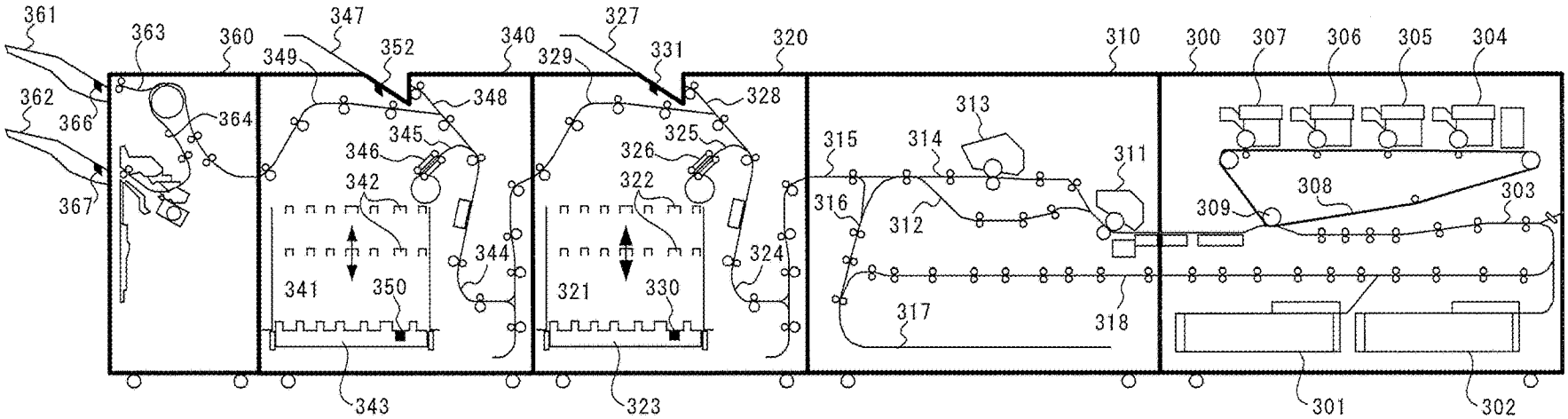
FIG. 3 is a sectional view for illustrating conveyance mechanisms of the image forming system.

Each of the image forming apparatus 101 and the sheet discharge apparatus 201, 202, and 203 includes a sheet conveyance mechanism as a mechanical element. FIG. 3 is an explanatory view for illustrating those conveyance mechanisms. In FIG. 3, an image forming unit 300 is a unit configured to form an image to be transferred onto a sheet, and corresponds to the image forming portion 124 in FIG. 1. An image fixing unit 310 is a unit configured to fix the transferred image. Two large-capacity stackers 320 and 340 and one finisher 360 are connected to the image fixing unit 310 in a daisy-chain configuration.

In the image forming unit 300, each of sheet feeding decks 301 and 302 separates one uppermost sheet among the received sheets to convey the sheet to a sheet conveyance path 303. Development stations 304 to 307 use toner having colors of yellow (Y), magenta (M), cyan (C), and black (K) to cause adhesion of toner images. The adhering toner images are primarily transferred onto an intermediate transfer belt 308. The intermediate transfer belt 308 rotates, for example, clockwise to convey the sheet to a secondary transfer position 309. At this time, the toner images are transferred onto the sheet conveyed through the sheet conveyance path 303. The sheet having the toner images transferred thereon is conveyed to the image fixing unit 310.

In the image fixing unit 310, a fixing unit 311 melts and pressurizes the toner images to fix the toner images onto the sheet. The sheet that has passed through the fixing unit 311 is conveyed from a sheet conveyance path 312 to a sheet conveyance path 315. Additional heating and pressurization may be required depending on the sheet type. In this case, after the sheet passes through the fixing unit 311, the sheet is conveyed to a second fixing unit 313 using a sheet conveyance path in the stage subsequent to the fixing unit 311. The sheet subjected to additional heating and pressurization is conveyed to a sheet conveyance path 314. A reversing portion 316 reverses the conveyed sheet by a switch-back method. When an image is formed on one side of the sheet, the reversed sheet, that is, the sheet having an image formed thereon, is conveyed to the sheet conveyance path 315. When images are formed on both sides of the sheet, the sheet is conveyed to a duplex reverse path 317, and is reversed to be conveyed to a duplex conveyance path 318. In this manner, an image is formed on the second side at the secondary transfer position 309, and the sheet is conveyed to the sheet conveyance path 315. The sheet that has passed through the sheet conveyance path 315 passes through a sheet conveyance path 324 to be input to the large-capacity stacker 320.

The large-capacity stacker 320 includes a stacking portion 321 including a lift tray 322 and an ejection tray 323, which are each configured to stack sheets. Those trays are controlled by the apparatus controller 211 illustrated in FIG. 2. The lift tray 322 is positioned at a sheet stacking portion having a predetermined height under a state in which no sheets are stacked, and is lowered when the stacking proceeds. The ejection tray 323 is a tray for re-stacking the sheets at a time point at which the lift tray 322 is lowered to a re-stacking position, to thereby eject the sheets to the outside of the apparatus. The lift tray 322 and the ejection tray 323 are formed so that their bars for supporting the sheets are present at alternate positions. Therefore, the sheets on the lift tray 322 can be re-stacked onto the ejection tray 323. The sheet passes through the sheet conveyance path 324 and a sheet conveyance path 325 to be conveyed to a sheet discharge unit 326. The sheet discharge unit 326 includes a lower rotary member and an upper rotary member that are configured to nip the sheet, and to discharge the sheet in a flipped manner to the lift tray 322. The action of "discharging the sheet in a flipped manner" refers to an action of discharging the sheet with the front and back sides being reversed so that one of both surfaces of the sheet on a side in contact with the lower rotary member of the sheet discharge unit 326 is turned to become an upper surface on the lift tray 322.

The lift tray 322 is controlled to be lowered by an amount of a height of the stacked sheets as the stacking of the sheets proceeds so that an upper end of the stacked sheets is always at a predetermined height. When the lift tray 322 is in a fully-stacked state, the lift tray 322 is lowered to the position of the ejection tray 323. The "fully-stacked state" refers to a state in which the sheets reach a maximum stackable amount of the lift tray 322 and no more sheets can be stacked on the lift tray 322. Then, at a time point at which the lift tray 322 reaches the re-stacking position that is lower than the ejection tray 323, the sheets are re-stacked onto the ejection tray 323. After that, the ejection tray 323 is carried to the outside of the apparatus. In this manner, the sheets are removable. This operation is called "ejecting operation".

The large-capacity stacker 320 further includes a top tray 327. The top tray 327 is one sheet stacking portion mainly used for outputting a sample of the sheets to be stacked on the stacking portion 321. During discharge to the stacking portion 321, one sheet (or one bundle) is output to the top tray 327 as a sample. In this manner, the quality of the image formation can be checked without taking out the sheets stacked in the stacking portion 321. When a sheet is output top tray 327, the sheet passes through the sheet conveyance path 324 and a sheet conveyance path 328 to be conveyed to the top tray 327. When a sheet is conveyed to an apparatus on the downstream of the large-capacity stacker 320, the sheet is conveyed through a sheet conveyance path 329.

The ejection tray 323 and the top tray 327 include sheet presence/absence detection sensors 330 and 331, respectively. The sheet presence/absence detection sensors 330 and 331 operate as one type of a detection device that may detect the change in stacking state of the sheets on the tray at every predetermined timing. The controller 121 acquires the detection results of the sheet presence/absence detection sensors 330 and 331 in time series, and updates the stacking state information 133 in the storage 122 based on the acquired detection results. The large-capacity stacker 340 has the same configuration as that of the large-capacity stacker 320. That is, the stacking portion 321 (lift tray 322 and ejection tray 323) of the large-capacity stacker 320 corresponds to a stacking portion 341 (lift tray 342 and ejection tray 343) of the large-capacity stacker 340. Similarly, the sheet conveyance paths 324, 325, 328, and 329 and the sheet discharge unit 326 of the large-capacity stacker 320 correspond to sheet conveyance paths 344, 345, 348, and 349 and a sheet discharge unit 346 of the large-capacity stacker 340, respectively. Further, the top tray 327 and the sheet presence/absence detection sensors 330 and 331 of the large-capacity stacker 320 correspond to a top tray 347 and sheet presence/absence detection sensors 350 and 352 of the large-capacity stacker 340, respectively. Those components are controlled by the apparatus controller 212.

The finisher 360 subjects the conveyed sheet to predetermined post-processing under the control of the apparatus controller 213 illustrated in FIG. 2 based on the function designated by the operator. As an example of the post-processing, in this example, the sheet is subjected to stapling (one-portion or two-portion binding) and punching (two or three holes). The finisher 360 includes two sheet discharge trays 361 and 362 each serving as a sheet stacking portion. To the sheet discharge tray 361, a sheet not to be subjected to post-processing, for example, stapling, is discharged through a sheet conveyance path 363. To the sheet discharge tray 362, a sheet subjected to a finishing function designated by the operator is discharged through a sheet conveyance path 364.

Each of the sheet discharge trays 361 and 362 is configured to be freely raised or lowered. It is also possible to perform such an operation that the sheet discharge tray 361 is lowered so that a plurality of sheets subjected to post-processing are stacked onto the sheet discharge tray 361. The sheet discharge trays 361 and 362 include sheet presence/absence detection sensors 366 and 367, respectively, which are each configured to detect the stacking state of the sheets on the tray. The sheet presence/absence detection sensors 366 and 367 also operate as one type of a detection device that may detect the change in stacking state of sheets on the tray at every predetermined timing. The detection results are transmitted to the image forming apparatus 101 in time series by the apparatus controllers included in the large-capacity stackers 320 and 340.

Next, description is given of the sheet stacking state in the large-capacity stacker 320 with reference to FIG. 4A to FIG. 4G. In each drawing, a right side as viewed from an observer corresponds to a sectional view in which the mechanical elements of the large-capacity stacker 320 are viewed from the front side, and a left side as viewed from the observer corresponds to a sectional view in which the mechanical elements of the large-capacity stacker 320 are viewed from the left lateral side. The large-capacity stacker 340 has a similar configuration, and hence the large-capacity stacker 320 is described as a representative stacker.

Figure 4A:
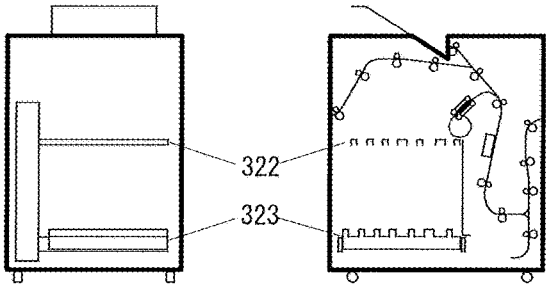
FIG. 4A, FIG. 4B, FIG. 4C, FIG. 4D, FIG. 4E, FIG. 4F, and FIG. 4G are schematic views for illustrating a process of an ejecting operation.
Figure 4B:
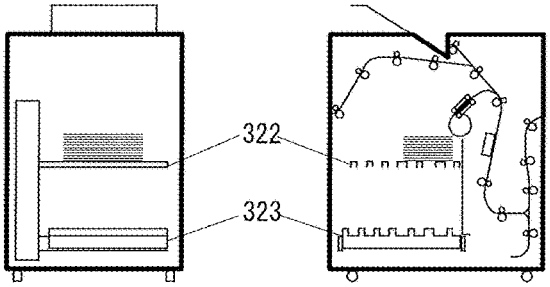
Figure 4C:
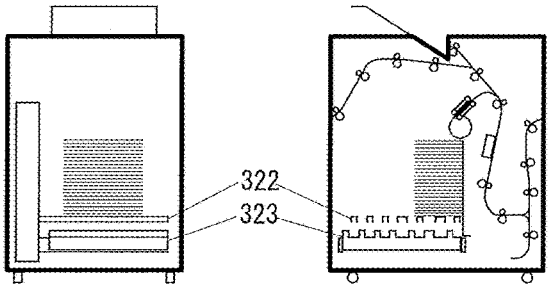
Figure 4D:
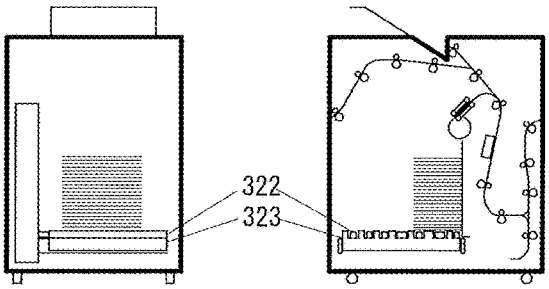

FIG. 4A is an illustration of a state in which no sheets are stacked on the large-capacity stacker 320. The lift tray 322 is raised and stopped at a predetermined height, that is, at a position of a sheet discharge port for discharging the sheets to the stacking portion 321. The ejection tray 323 is accommodated in the apparatus. FIG. 4B is an illustration of a state during an image forming operation. As the stacking of the sheet proceeds, the apparatus controller gradually lowers the lift tray 322 so that the height of the uppermost surface of the stacked sheets matches the position of the sheet discharge port of the stacking portion 321. FIG. 4C is an illustration of a state in which a fully-stacked state of the lift tray 322 is detected. When the lift tray 322 is in the fully-stacked state, stacking onto the lift tray 322 cannot be continued any more. Therefore, the apparatus controller starts control of re-stacking the stacked sheets onto the ejection tray 323. FIG. 4D is an illustration of a state in which the lift tray 322 is lowered to the re-stacking position of the ejection tray 323 and the sheets are re-stacked onto the ejection tray 323. Even when the lift tray 322 is lowered to the same height as that of the ejection tray 323, the bars for supporting the sheets are located at alternate positions, and hence the bars do not interfere with each other. At a time point at which the lift tray 322 reaches the re-stacking position that is lower than the ejection tray 323, there is obtained a state in which the sheets stacked on the lift tray 322 are re-stacked onto the ejection tray 323.

Figure 4E:
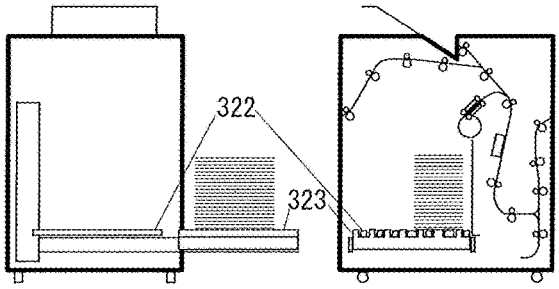
Figure 4F:
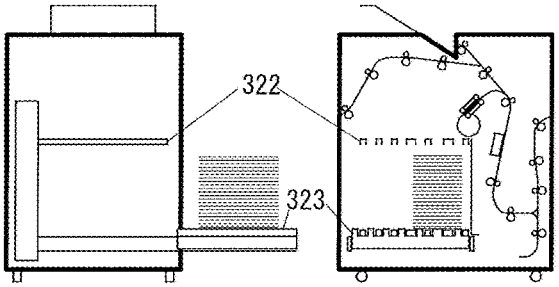
Figure 4G:
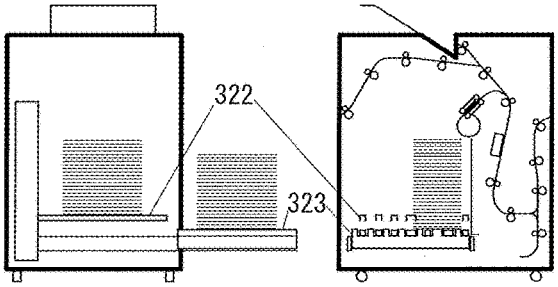

FIG. 4E is an illustration of a state in which the ejection tray 323 having the sheets stacked thereon is ejected to the outside of the apparatus. When the ejection tray 323 is ejected as described above, the stacked sheets become collectable. FIG. 4F is an illustration of a state in which, under a state in which the ejection tray 323 is ejected, the lift tray 322 is raised again to the position at which the subsequent sheets are stacked thereonto. In this manner, sheets can be stacked on the lift tray 322. FIG. 4G is an illustration of a state in which, after the image formation is continued under a state in which the ejection tray 323 is ejected, the fully-stacked state of the lift tray 322 is detected. In this state, the ejection tray 323 is ejected, and hence the sheets stacked on the lift tray 322 cannot be re-stacked onto the ejection tray 323. The sheets stacked on the ejection tray 323 are required to be collected to continue the stacking in the large-capacity stacker 320.

FIG. 5 is a diagram of a monitor screen to be displayed on the display 113 of the information processing apparatus 100 when a job is processed in the image forming apparatus 101. The display content of this screen is generated by the controller 111 based on the apparatus display information 132 received from the image forming apparatus 101. Alternatively, the controller 121 of the image forming apparatus 101 may generate the display content. The content of the apparatus display information 132 differs depending on the combination of the sheet discharge apparatus. In the first embodiment, for the sake of convenience of description, it is assumed that the apparatus display information 132 corresponding to all combinations of mountable sheet discharge apparatus is stored in advance. As an example, description is given of an example of the apparatus display information 132 corresponding to the apparatus configuration exemplified in FIG. 3. A schematic diagram is used in FIG. 5, but the actual apparatus display information 132 is stored in a form of an extensible markup language (XML) or comma-separated values (CSV), for example.

The upper stage of FIG. 5 represents a system configuration image 501 that visualizes the entire arrangement mode by expressing the entire arrangement mode in, for example, a bitmap format, and the lower stage of FIG. 5 represents a table in which information on position of the sheet discharge tray included in each sheet discharge apparatus is stored. The system configuration image 501 can be displayed as a two-dimensional image or a three-dimensional image, but is displayed as a three-dimensional image in this case. A sheet or a sheet bundle is not drawn in the system configuration image 501 illustrated at the upper stage of FIG. 5, but when a sheet is conveyed, a structure image of the sheet discharge tray at the stacking portion for the sheet is also rendered (displayed). For example, there is displayed a system configuration image including a structure image representing the lift tray 322 and the ejection tray 323, which are displaced in the above-mentioned large-capacity stackers 320 and 340. In the example illustrated in FIG. 3, each of the large-capacity stackers 320 and 340 includes three sheet discharge trays (top tray, lift tray, and ejection tray), and the finisher 360 includes two sheet discharge trays (upper tray and lower tray). Therefore, in such an arrangement mode, a total of eight sheet discharge trays are usable. In the system configuration image 501 at the upper stage of FIG. 5, an actual arrangement mode and structure images of those sheet discharge apparatus and sheet discharge trays are displayed. Therefore, the operator can intuitively recognize which sheet discharge tray the sheets are stacked on and whether the sheets are collectable.

In the table shown at the lower stage of FIG. 5, each of records of trays #1 to #8 corresponds to a sheet discharge apparatus 521 to which each tray is installed, a tray type 522, and tray position coordinates 523. That is, "tray #1" is the top tray of the large-capacity stacker 320, and is provided at tray position coordinates (396, 102) with reference to the system configuration image 501. The tray position coordinates are offset values (pixel numbers) in a right direction and a lower direction with the upper left of the system configuration image 501 serving as an origin. Other trays #2 to #8 have similar content.

Figure 6:
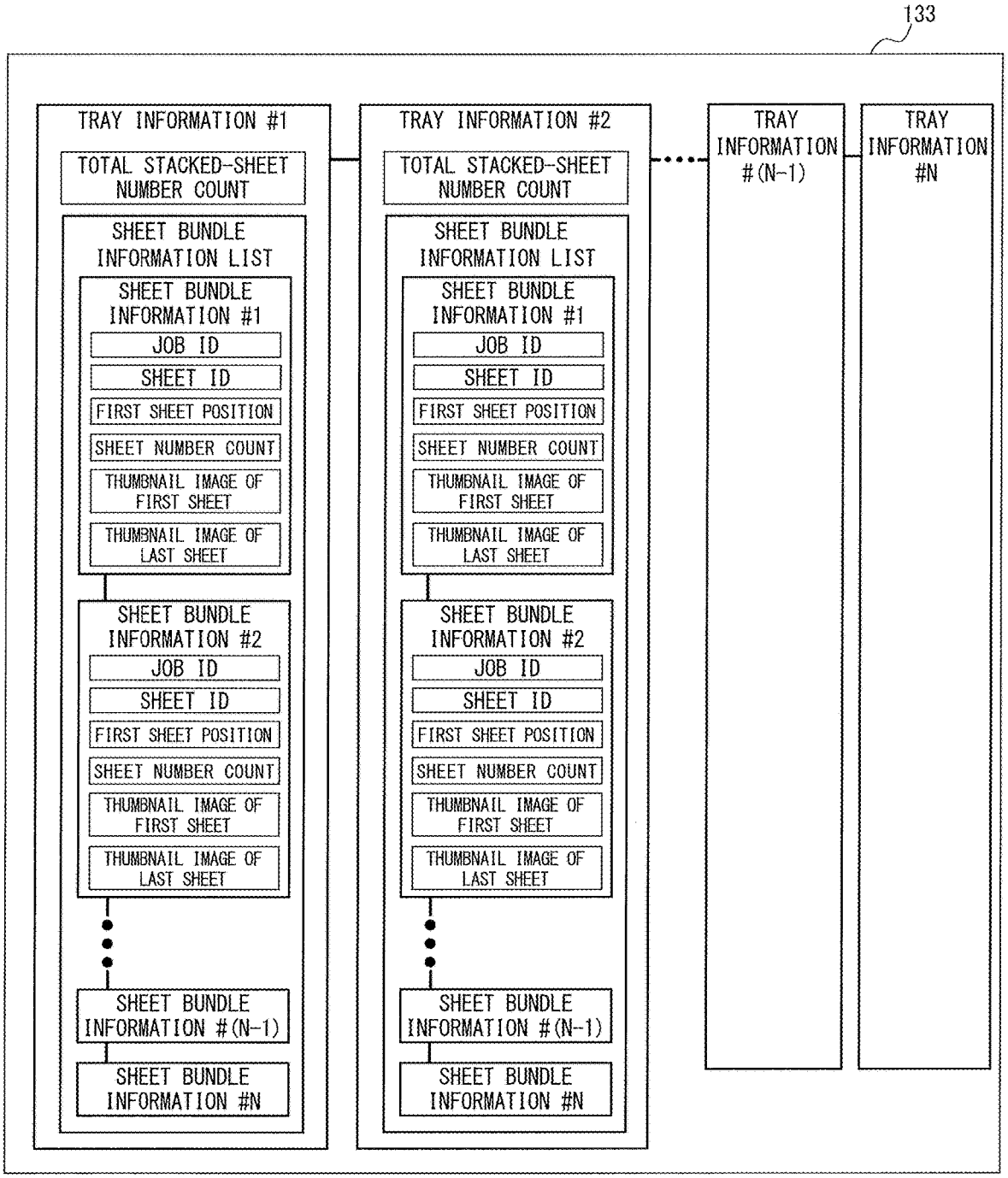
FIG. 6 is a diagram of stacking state information.

FIG. 6 is a diagram of the stacking state information 133. The stacking state information 133 is stored in the storage 122. The stacking state information 133 is updated, for example, at a timing at which the detection result of a display mode is acquired at a plurality of positions in each sheet discharge tray, and can be referred to as appropriate. The stacking state information 133 has a list-type data structure. That is, tray information representing the sheet or sheet-bundle stacking state of the usable sheet discharge tray for each tray is represented as tray information #1 to tray information # N. In the following description, for the sake of convenience, at least one sheet is referred to as "sheet bundle" in some cases. In the relationship with the table shown at the lower stage of FIG. 5, the detection result of the above-mentioned stacking state in the tray #1 corresponds to the tray information #1. The same applies to the tray information #2, the tray information #(N−1), and the tray information # N. N is a natural number, and N is 8 in the case of the apparatus configuration illustrated in FIG. 3.

In FIG. 6, the tray information #1 to the tray information #8 are in a data format having a "total stacked-sheet number count" and a "sheet bundle information list" as member variables. The "total stacked-sheet number count" is a variable for counting a total number of sheets stacked on the sheet discharge tray. In the "sheet bundle information list", pieces of sheet bundle information for representing the information relating to each sheet bundle are arranged in a list in the stacking order of the sheets. When no sheets are stacked on any sheet discharge tray, the "sheet bundle information list" is an empty list. Each piece of sheet bundle information has, as member variables, a "job ID", a "sheet ID", a "first sheet position", a "sheet number count", a "thumbnail image of the first sheet", and a "thumbnail image of the last sheet". The "job ID" is a variable representing an ID of an image forming job corresponding to the sheet bundle. Each image forming job is allocated with a unique ID by the image forming apparatus 101, and the ID is stored in the member variable. The "sheet ID" is a variable representing an ID of the sheet corresponding to the sheet bundle. The sheet is defined based on characteristics such as a size, a basis weight, and states of the front and back surfaces, and a sheet ID allocated for identifying the sheet is recorded in the member variable. The "first sheet position" is a variable representing what number the first sheet of the sheet bundle corresponds to when counted from the first sheet stacked on the sheet discharge tray. The "sheet number count" is a variable for counting the total number of sheets of the sheet bundle. The "thumbnail image of the first sheet" is an example of an image that allows identification of a sheet part of the first sheet of the sheet bundle, and is a variable for storing the thumbnail image of the first sheet of the sheet bundle. The "thumbnail image of the last sheet" is a variable for storing the thumbnail image of the last sheet of the sheet bundle.

Figure 7:
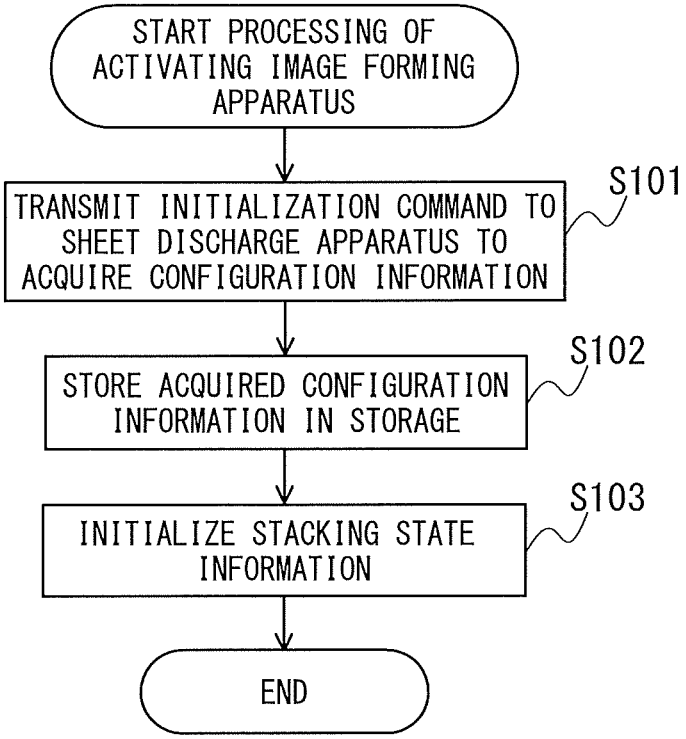
FIG. 7 is a control flow for illustrating an operation procedure at the time when the image forming apparatus is activated.

Next, an operation of the image forming system according to the first embodiment is described. First, the operation of the image forming apparatus 101 at the time of activation thereof is described with reference to FIG. 7. FIG. 7 is a control flow to be executed when the image forming apparatus 101 is activated. This control flow is executed by the controller 121 controlling the respective portions of the apparatus. When the image forming apparatus 101 is activated, the controller 121 transmits an initialization command to all of the mounted sheet discharge apparatus (Step S101). The initialization command is transmitted to each sheet discharge apparatus via the communication cable. After each sheet discharge apparatus receives the initialization command, the sheet discharge apparatus transmits back to the image forming apparatus 101 the sheet discharge apparatus ID for identifying the type of the own apparatus.

The controller 121 stores the system configuration information acquired from each sheet discharge apparatus in the storage 122 (Step S102). The system configuration information may include the sheet discharge apparatus ID. With the acquired system configuration information, it can be recognized how the sheet discharge apparatus mounted to the image forming apparatus 101 are currently arranged (order of the sheet discharge apparatus and the like), and as a result, where the sheet stacking portion is positioned. The controller 121 may identify the apparatus display information 132 corresponding to the arrangement mode of the currently-mounted sheet discharge apparatus based on the stored sheet discharge apparatus ID from the apparatus display information 132 stored in advance in accordance with the combination of the sheet discharge apparatus. For example, in the arrangement mode illustrated in FIG. 3, the apparatus display information 132 corresponding to the configuration in which two large-capacity stackers and one finisher are mounted is identified.

After the apparatus display information 132 is identified, the controller 121 initializes the stacking state information 133 (Step S103). That is, the stacking state information 133 is newly generated based on the sheet discharge apparatus ID stored in Step S102. Sheets are not stacked yet on any sheet discharge tray immediately after the image forming apparatus 101 is activated. Therefore, in each piece of tray information of the stacking state information 133, the total stacked-sheet number count is 0, and the sheet bundle information list is an empty list.

Figure 8:
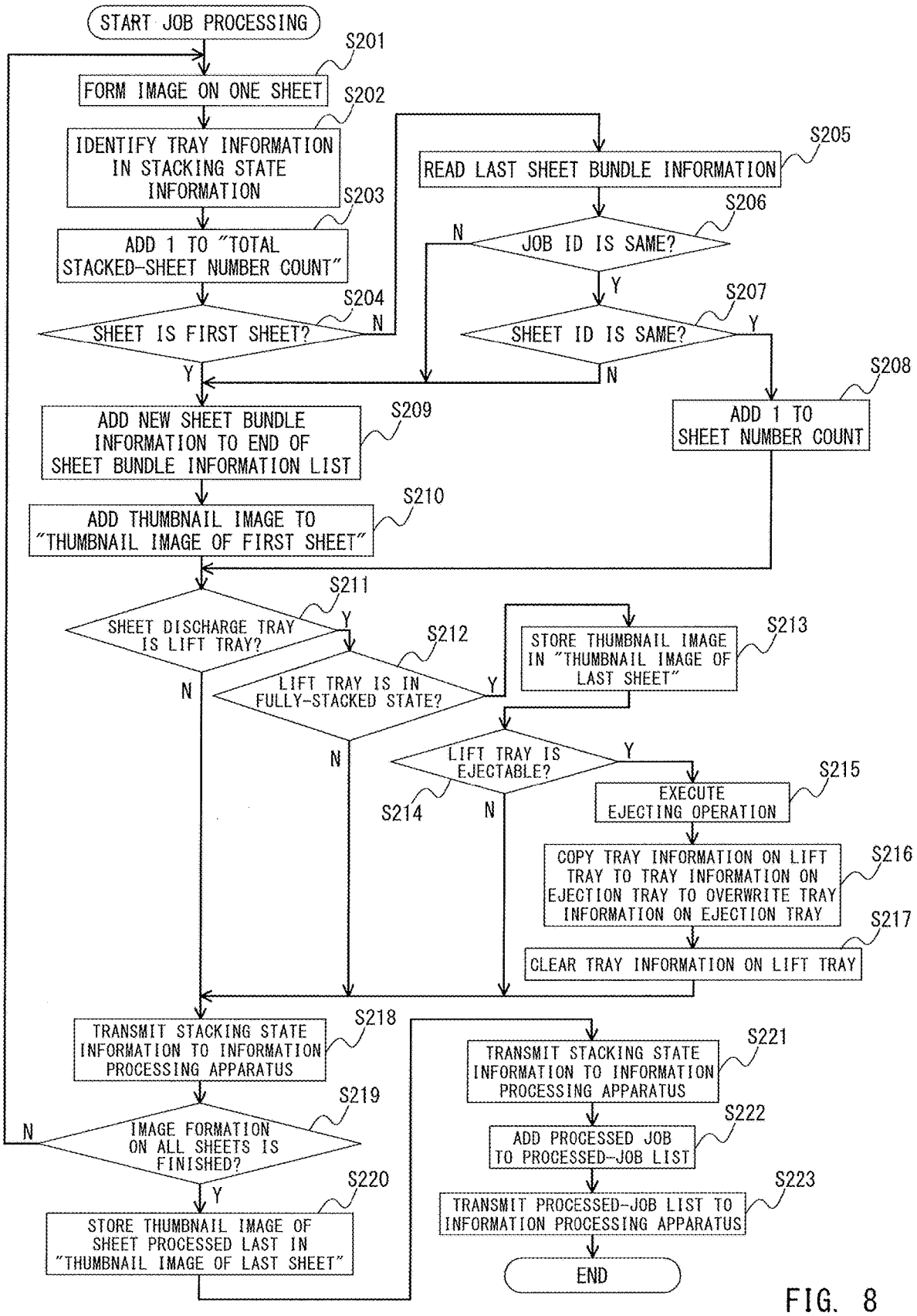
FIG. 8 is a control flow for illustrating a procedure at the time when an image forming job is processed in the image forming apparatus.

Next, with reference to FIG. 8, description is given of an operation example at the time when the image forming job is processed in the image forming apparatus 101. It is assumed that the image forming job is received from, for example, the information processing apparatus 100. The image forming job includes designation of tray information on the sheet stacking portion, that is, the sheet discharge apparatus to which sheets having images formed thereon are stacked. In the following description, it is assumed that the tray information (top tray or lift tray 322) on the large-capacity stacker 320 is designated. FIG. 8 is a control flow of the image forming apparatus 101 at this time. This control flow is also executed by the controller 121 integrally controlling the respective portions of the apparatus.

In the image forming apparatus 101, image formation of one sheet is performed in the order of pages in accordance with the image forming job. After the image formation, the conveyance of the sheet toward the large-capacity stacker 320 designated by the job is started (Step S201). At this time, the controller 121 identifies the tray information on the designated large-capacity stacker 320 (Step S202). The tray information can be identified by referring to the apparatus display information 132 determined based on the arrangement mode of the sheet discharge apparatus. For example, a focus is put on tray #1 of the tray information of the table at the lower stage of FIG. 5. Tray #1 corresponds to the top tray of the large-capacity stacker 320. Similarly, tray #2 corresponds to the lift tray of the large-capacity stacker 320. When tray #2 is identified in the image forming job, the controller 121 refers to the record of tray #2 as the tray information.

The controller 121 adds 1 to the "total stacked-sheet number count" of the identified tray information (Step S203). The controller 121 further determines whether or not the discharged sheet is the first sheet in sheet discharge tray based on the value of the "total stacked-sheet number count" (Step S204). When the sheet is not the first sheet (Step S204: N), the controller 121 refers to the tray information to read last sheet bundle information in the "sheet bundle information list" (Step S205). Then, the controller 121 determines whether or not the "job ID" of the job being processed (for which the image formation is performed) is the same as the "job ID" in the sheet bundle information read in Step S205 (Step S206). When the "job ID" is the same (Step S206: Y), the controller 121 determines whether or not the "sheet ID" of the sheet subjected to image formation in Step S201 is the same as the "sheet ID" in the sheet bundle information read in Step S205 (Step S207). When the "sheet ID" is the same (Step S207: Y), the controller 121 adds 1 to the "sheet number count" of the last sheet bundle information in the tray information (Step S208), and the processing proceeds to Step S211.

When the sheet is the first sheet in Step S204 (Step S204: Y), when the "job ID" differs in Step S206 (Step S206: N), and when the "sheet ID" differs in Step S207 (Step S207: N), the controller 121 executes the processing of Step S209. That is, new sheet bundle information is added at the end of the sheet bundle information list in the tray information. The member variables of the added new sheet bundle information are as follows. First, the "job ID" is the job ID of the job for which the image formation is performed. The "sheet ID" is a sheet ID corresponding to the sheet subjected to image formation in Step S201. The "total stacked-sheet number count" is input as the first sheet position. The "sheet number count" is 1. The "thumbnail image of the first sheet" and the "thumbnail image of the last sheet" are undetermined because which sheet is the first sheet or the last sheet of the sheet bundle is unknown when new sheet bundle information is added. After that, the sheet subjected to image formation when the new sheet bundle information is added is the first sheet, and hence the controller 121 stores the image of the sheet subjected to image formation in Step S201 as the "thumbnail image of the first sheet" (Step S210), and the processing proceeds to Step S211.

Next, in Step S211, the controller 121 determines whether or not the sheet discharge tray designated in Step S201 is the lift tray of the large-capacity stacker 320. When the sheet discharge tray is the lift tray (Step S211: Y), the controller 121 determines whether or not the lift tray 322 is in the fully-stacked state due to sheets discharged in Step S201 (Step S212). When the lift tray 322 is in the fully-stacked state (Step S212: Y), the sheet subjected to image formation in Step S201 is the last sheet of the lift tray 322. In view of this, the controller 121 stores the image of the sheet subjected to image formation in Step S201 as the "thumbnail image of the last sheet" of the current sheet bundle information in the stacking state information 133 (Step S213). After that, the controller 121 determines whether or not the lift tray 322 that is detected to be in the fully-stacked state in Step S212 is ejectable (Step S214). Whether the lift tray 322 is ejectable is determined based on whether or not the sheet bundles are stacked on the ejection tray 323 of the same large-capacity stacker 320. When the sheet bundles are stacked on the ejection tray 323, that is, when the sheet presence/absence detection sensor 330 or the sheet presence/absence detection sensor 331 detects that the sheet bundles are stacked, the controller 121 determines that the lift tray is not ejectable. Otherwise, the controller 121 determines that the lift tray is ejectable. When the lift tray 322 is ejectable (Step S214: Y), the controller 121 re-stacks the sheet bundles stacked on the lift tray detected to be in the fully-stacked state in Step S212 onto the ejection tray 323, and executes the ejecting operation (Step S215). After that, the controller 121 copies, in the stacking state information 133, the tray information on the lift tray 322 for which the ejecting operation of the large-capacity stacker 320 is executed in Step S215, to the tray information on the same large-capacity stacker 320 to overwrite the tray information on the same large-capacity stacker 320 (Step S216). Further, the controller 121 clears, in the stacking state information 133, the tray information on the lift tray 322 for which the ejecting operation is executed in Step S215 (Step S217). In this case, "clearing the tray information" refers to obtaining an empty sheet bundle information list by setting the "total stacked-sheet number count" in the tray information to 0.

When the sheet discharge tray is not the lift tray 322 (Step S211: N), when the lift tray 322 is not in the fully-stacked state (Step S212: N), and when the lift tray 322 is not ejectable (Step S214: N), the controller 121 transmits the stacking state information 133 to the information processing apparatus 100 (Step S218). The same is applied after the tray information on the lift tray 322 is cleared (Step S217). After that, the controller 121 determines whether or not the image formation of all of the sheets by the image forming job is finished (Step S219). When the image formation is not finished yet (Step S219: N), the processing returns to Step S201. When image formation on all sheets is finished (Step S219: Y), the controller 121 stores the thumbnail image of the sheet that is processed last as the "thumbnail image of the last sheet" of the sheet bundle information of the stacking state information 133 (Step S220). After that, the controller 121 transmits the stacking state information 133 to the information processing apparatus 100 (Step S221). Further, the controller 121 lists (adds) the jobs that have finished processing on all sheets to the processed-job list 131 (Step S222), and transmits the processed-job list 131 to the information processing apparatus 100 (Step S223). Thus, the series of processing is ended.

Figure 9:
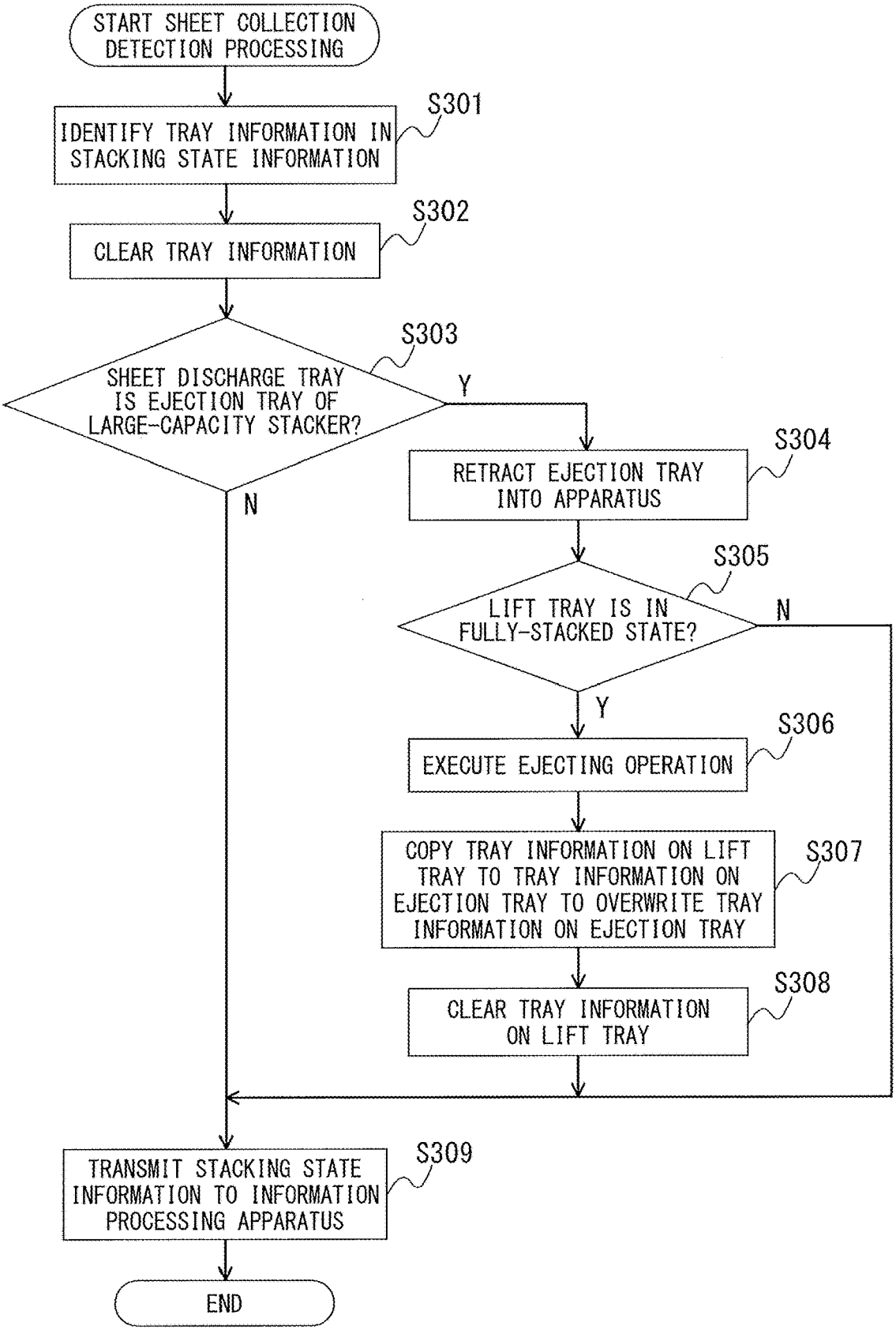
FIG. 9 is a control flow for illustrating a procedure of sheet collection detection processing.

Next, with reference to FIG. 9, description is given of an operation performed when the collection of sheets from the sheet discharge tray is detected in the image forming apparatus 101. Now, description is given of an example in which sheets are collected from the ejection tray 323 of the large-capacity stacker 320. FIG. 9 is a control flow of sheet collection detection processing. This control flow is also executed by the controller 121 integrally controlling the respective portions of the apparatus. The sheet collection is detected when a state in which the sheet presence/absence detection sensor 330 detects the stacking of the sheet bundles is changed to a state in which the stacking is not detected any more.

The controller 121 refers to the stacking state information 133 to identify the tray information corresponding to the sheet discharge tray at which the sheet collection is detected (Step S301). Then, the controller 121 clears the tray information (Step S302). The controller 121 further determines whether or not the sheet discharge tray is the ejection tray 323 of the large-capacity stacker 320 (Step S303). When the sheet discharge tray is the ejection tray 323 (Step S303: Y), the controller 121 retracts the ejection tray 323 into the apparatus (large-capacity stacker 320) (Step S304). Further, the controller 121 determines whether or not the lift tray 322 of the large-capacity stacker 320 at which the sheet collection is detected is in the fully-stacked state (Step S305). When the lift tray 322 is in the fully-stacked state (Step S305: Y), the controller 121 re-stacks the sheets stacked on the lift tray 322 in the fully-stacked state onto the ejection tray 323 to execute the ejecting operation (Step S306). Then, the controller 121 copies, in the stacking state information 133, the tray information on the lift tray 322 for which the ejecting operation is executed, to the tray information on the ejection tray 323 of the large-capacity stacker 320 to overwrite the tray information on the ejection tray 323 (Step S307). After that, the controller 121 clears, in the stacking state information 133, the tray information on the lift tray 322 for which the ejecting operation is executed (Step S308).

When the sheet discharge tray corresponding to the empty tray information is not the ejection tray 323 (Step S303: N), the controller 121 transmits the stacking state information 133 to the information processing apparatus 100 (Step S309), and ends the series of processing. The same processing is performed when the lift tray 322 is not in the fully-stacked state (Step S305: N) and after the tray information on the lift tray 322 is cleared in Step S308.

Figure 10:
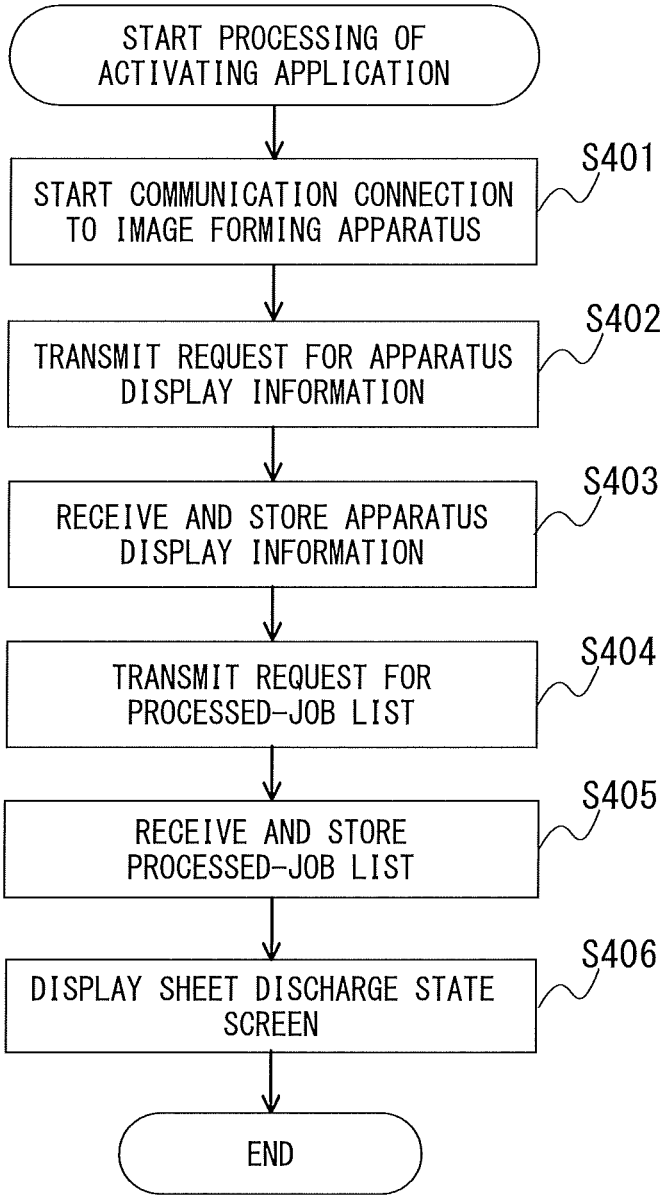
FIG. 10 is a control flow for illustrating an operation procedure of an information processing apparatus (at the time of activation).

The operator can recognize the stacking state of each sheet discharge apparatus mounted to the image forming apparatus 101 as required by an application executed by the computer program for terminal control in the information processing apparatus 100. The operation of the information processing apparatus 100 at this time is described with reference to FIG. 10. FIG. 10 is a control flow of processing of activating the application. This control flow is executed by the controller 111 integrally controlling the respective portions of the terminal.

When an application is activated in the information processing apparatus 100, the controller 111 starts communication connection to the image forming apparatus 101 (Step S401). The communication connection refers to continuous establishment of a communication path until the operator inputs a clear cancel instruction. When the communication path is established, a request of acquiring the apparatus display information 132 is transmitted to the image forming apparatus 101 (Step S402). When the image forming apparatus 101 receives this acquisition request, the image forming apparatus 101 transmits the apparatus display information 132 corresponding to the current arrangement mode. When the apparatus display information 132 is updated while the communication connection is established, the image forming apparatus 101 transmits the updated apparatus display information 132 to the information processing apparatus 100. When the information processing apparatus 100 acquires the updated apparatus display information 132 from the image forming apparatus 101, the information processing apparatus 100 sequentially stores the apparatus display information 132 to the storage 112 (Step S403).

The information processing apparatus 100 further transmits a request for the stacking state information and the processed-job list to the image forming apparatus 101 (Step S404). When the image forming apparatus 101 (controller 121) receives this request, the image forming apparatus 101 (controller 121) transmits the stacking state information 133 and the processed-job list 131 that are currently stored to the information processing apparatus 100. The information processing apparatus 100 stores the stacking state information 133 and the processed-job list 131 acquired from the image forming apparatus 101 to the storage 112 (Step S405). Further, the information processing apparatus 100 generates a sheet discharge state screen based on the stored apparatus display information 132, stacking state information 133, and processed-job list 131 to display the sheet discharge state screen on the display 113 (Step S406).

Figure 11:
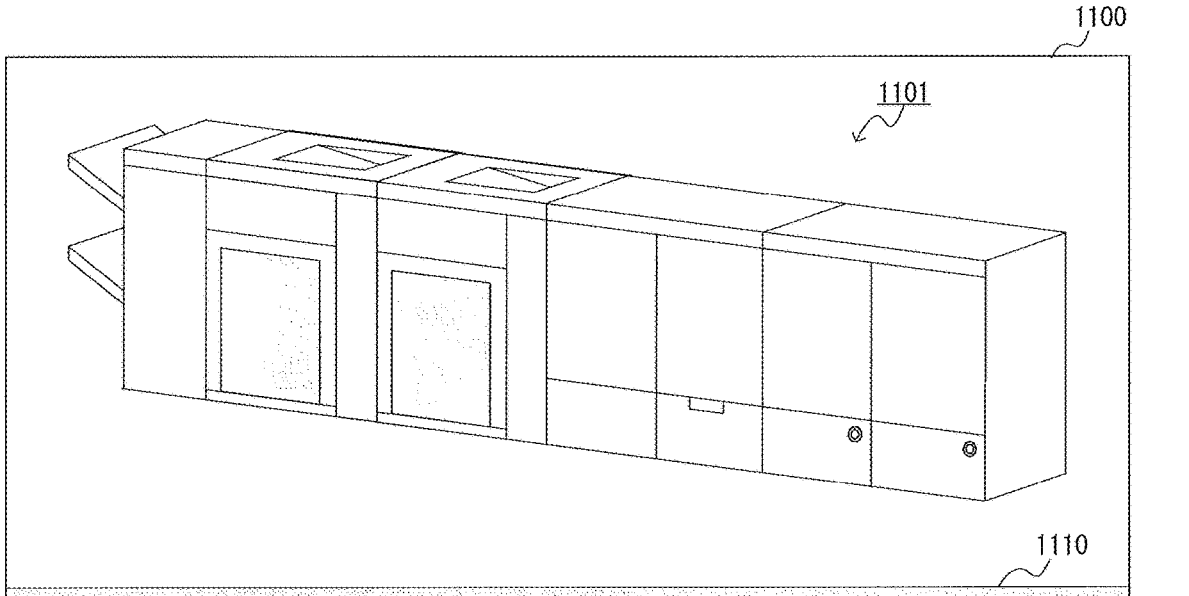
FIG. 11 is a diagram of a monitor screen.

An example of a monitor screen is illustrated in FIG. 11. In a monitor screen 1100 exemplified in FIG. 11, an image region 1101 and a list region 1110 are formed. The image region 1101 is a region for visually displaying the system configuration image and the above-mentioned stacking state, and has a two-display-layer structure. That is, the image region 1101 includes a first display layer for displaying the system configuration image, and a second display layer for mapping and displaying a sheet bundle image that visualizes the stacking state at the sheet stacking portion of the system configuration image on the first display layer. In the first display layer, the system configuration image (system configuration image 501 illustrated in FIG. 5) generated based on the apparatus display information 132 stored in Step S403 is displayed. In the second display layer, based on the stacking state information 133 received by the information processing apparatus 100, the sheet bundle image that is generated in accordance with the above-mentioned stacking state in each sheet discharge tray is displayed. The display of the sheet bundle image is updated in real time at a timing at which the change in stacking state is detected. That is, the controller 111 is configured so that the mode of displaying the sheet bundle image on the display 113 can be changed in real time in accordance with execution of each image forming job.

In FIG. 11, the system configuration image 1101 in a state in which no sheet bundles are stacked on the sheet discharge tray is displayed. The list region 1110 is an example of a list display device, and the processed job list 131 received by the information processing apparatus 100 from the image forming apparatus 101 is displayed in the list region 1110. In the processed-job list 131, job attributes (job ID, image forming job name, number of pages, number of bundles, and used sheet) of at least one processed job are displayed. The controller 111 allows the sheet bundle image to be displayed in the order in the processed-job list 131. Further, the controller 111 allows the sheet bundle image corresponding to the designated processed job and the sheet bundle image corresponding to other processed jobs to be displayed in a distinguished manner.

The operator can operate the input portion 114 to selectively designate any processed job on the processed-job list. In the example of FIG. 11, there is illustrated a state in which a processed job (job name: image forming job #3) having a job ID of "00000003" is designated. When the number of processed jobs listed in the processed-job list is larger than the number of jobs that can be displayed at one time in the list region 1110, a scroll bar 1111 is used. The operator can operate the scroll bar 1111 to designate any processed job. The designated processed job is displayed in an emphasized (for example, highlighted or inverted) manner to be distinguished from other processed jobs.

Figure 12:
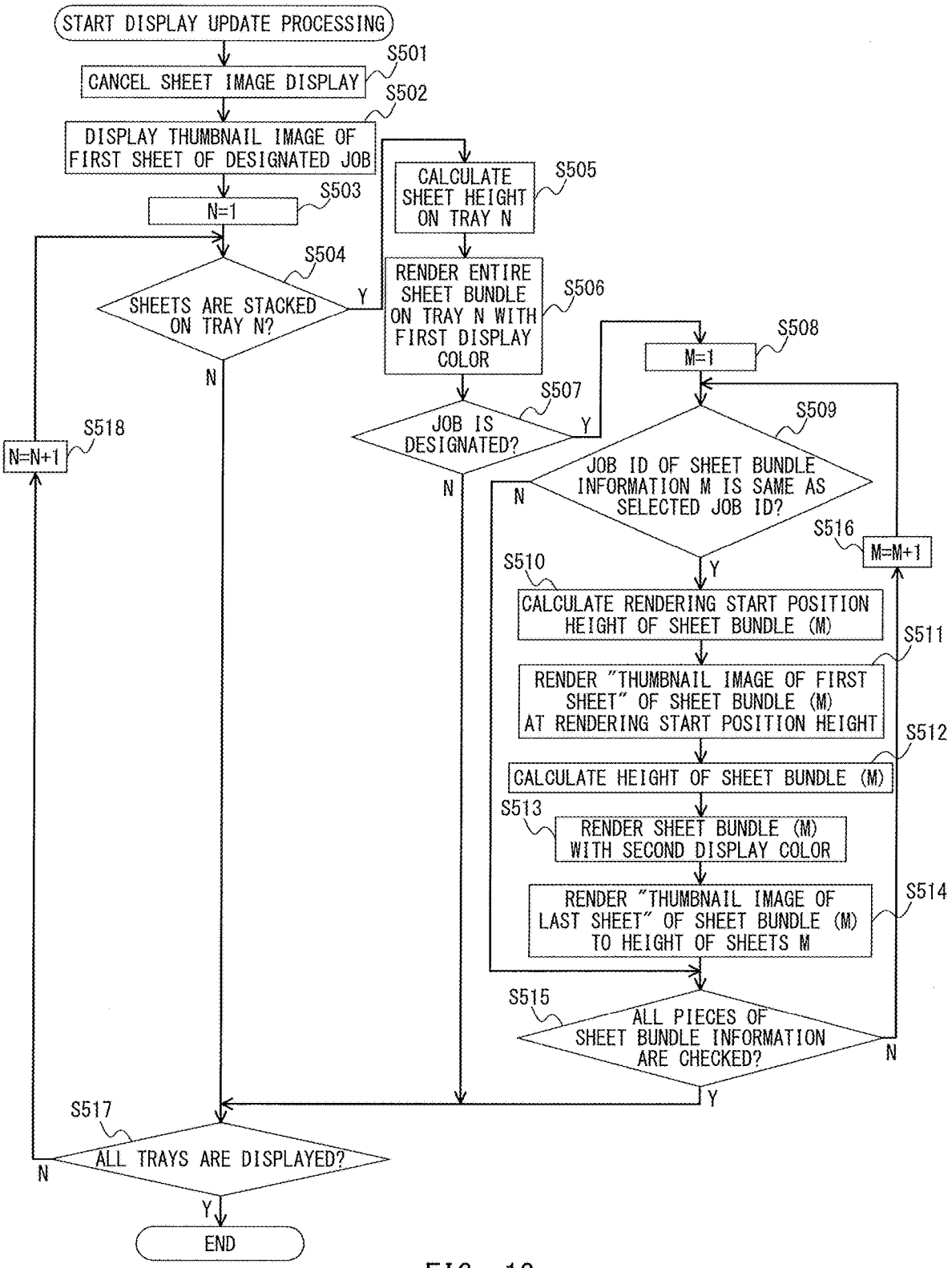
FIG. 12 is a control flow for illustrating a procedure at the time when the image forming job is changed.

Next, description is given of an operation example of a case in which the stacking state information 133 is received in the image forming apparatus 101, or a case in which the image forming job is changed. FIG. 12 is a control flow to be executed by the controller 111 of the information processing apparatus 100 at this time. In FIG. 12, the controller 111 cancels the display of the sheet bundle image displayed in the second display layer of the image region 1101 (Step S501), and then displays the "thumbnail image of the first sheet" of the designated image forming job (Step S502). Next, the controller 111 substitutes 1 for a variable N representing the stacking order of the sheet discharge tray (Step S503), and then determines whether or not the sheets are stacked on the tray N in the stacking state information (Step S504). When the "total stacked-sheet number count" in the tray information N is 0, it is determined that no sheets are stacked. When the sheets are stacked (Step S504: Y), the controller 111 calculates a height (h1 in FIG. 13) of the sheet bundle stacked on the tray N (Step S505). In this case, when the entire sheet bundle stacked on the tray N is displayed, the pixel of the height of the sheet bundle is calculated. The height of the sheet bundle is calculated by multiplying the "total stacked-sheet number count" of the tray information N by a predetermined coefficient P. The coefficient P is a coefficient representing the pixel corresponding to the height of one sheet. When the height of the sheet bundle includes a decimal value as a result of calculation, the value is rounded up to an integer value.

After the height of the sheet bundle is calculated, the controller 111 renders the entire sheet bundle on the tray N with a first display color (Step S506). After that, the controller 111 determines whether or not a job, that is, a processed job, is designated in the list region (Step S507). When no processed job is designated (Step S507: N), the processing proceeds to Step S517. When the processed job is designated (Step S507: Y), the controller 111 substitutes 1 for a variable M representing the order of the sheet bundle information (Step S508). The sheet bundle information M thereafter represents the M-th sheet bundle information in the sheet bundle information list of the tray information N of the received stacking state information.

The controller 111 then determines whether or not the "job ID" of the sheet bundle information M is the same as the "job ID" of the image forming job designated in the list region 1110 (Step S509). When the "job ID" is not the same (Step S509: N), the processing proceeds to Step S515. When the "job ID" is the same (Step S509: Y), the controller 111 calculates a rendering start height offset ("s" in FIG. 14A to FIG. 14C) of the sheet bundle corresponding to the sheet bundle information M, that is, the sheet bundle (M) (Step S510). The rendering start position height of the sheet bundle (M) is calculated by multiplying the rendering start position of the sheet bundle corresponding to the sheet bundle information M by the above-mentioned coefficient P. When the rendering start position height offset includes a decimal value as a result of the calculation, the value is rounded down to an integer value.

Next, the controller 111 renders the thumbnail image stored as the "thumbnail image of the first sheet" of the sheet bundle (M) at a rendering start position height offset of the sheet bundle (M) obtained in Step S510 (Step S511). In this manner, the thumbnail image of the first sheet in the tray N of the designated processed job can be displayed as the first sheet. The controller 111 further calculates the height of the sheet bundle (M) (Step S512). That is, the controller 111 calculates the pixel corresponding to the height of the sheet bundle (M) when the sheet bundle image is displayed on the display 113. The height of the sheet bundle (M) is calculated by multiplying the sheet number count by the above-mentioned coefficient P. When the height of the sheet bundle includes a decimal value as a result of the calculation, the value is rounded up to an integer value.

After the height of the sheet bundle (M) is calculated, the controller 111 renders the sheet portion of the sheet bundle (M) with a second display color that is different from the first display color (Step S511). In this manner, the sheet bundle image representing the portion of the sheet bundle of the designated processed job is displayed with the second display color. Next, the controller 111 renders the thumbnail image of the sheet stored in the "thumbnail image of the last sheet" of the sheet bundle information M at a position having the height of the sheet bundle (M) obtained in Step S512 (Step S514). In this manner, the thumbnail image of the last sheet in the tray N of the designated processed job can be displayed. After that, the controller 111 determines whether or not all pieces of sheet bundle information in the sheet bundle information list of the tray information N have been checked (Step S515). When not all pieces of sheet bundle information have been checked (Step S515: N), the controller 111 adds 1 to the variable M (Step S516), and the processing returns to Step S509. When all pieces of sheet bundle information have been checked (Step S515: Y), the controller 111 determines whether or not all pieces of tray information have been displayed for the received stacking state information 133 (Step S517). When not all pieces of tray information have been displayed (Step S517: N), the controller 111 adds 1 to the variable N (Step S518), and the processing returns to Step S504. When all pieces of tray information have been displayed (Step S517: Y), the series of processing is ended.

Now, the outline of the rendering of the entire sheet bundle, which is performed in Step S506, is described with reference to FIG. 13A to FIG. 13C. In this case, as an example, description is given of a sheet bundle to be stacked on the ejection tray 323 of the large-capacity stacker 320. A height h1 of a sheet bundle 1301 illustrated in FIG. 13A is the height calculated in Step S505. The sheet bundle 1301 is displayed by seven points of vertex A to vertex G. In a list 1302 of FIG. 13B, which represents a method of calculating the coordinates of each vertex, the vertex A has tray position coordinates (coordinate values thereof are expressed as (x, y)) in the sheet discharge tray. The tray position coordinates of each sheet discharge tray are stored in the apparatus display information 132 stored in Step S403. The coordinate values of other vertices (B to G) are determined by adding or subtracting a predetermined offset value and the sheet height h1 to or from the coordinate values (x, y) of the vertex A.

The sheet bundle 1301 is rendered by a rendering command of, for example, scalable vector graphics (SVG). In FIG. 13C, there is shown an example of a rendering command 1303 of the sheet bundle 1301 at the time when the SVG is used. The shape of the sheet bundle 1301 differs depending on the shape of the corresponding sheet discharge tray, but the point that the shape is determined based on the tray position coordinates, the predetermined offset value, and the sheet height is the same.

Next, a procedure of rendering the sheet bundle to be performed in Step S513 is described with reference to FIG. 14A to FIG. 14C. In this case, similarly to FIG. 13A to FIG. 13C, description is given of the sheet bundle to be stacked on the ejection tray 323 of the large-capacity stacker 320. FIG. 14A is an illustration of a sheet bundle (M) 1401 rendered in Step S513. A height h2 of the sheet bundle (M) is the height calculated in Step S512. The sheet bundle (M) 1401 is displayed by seven points of vertex H to vertex N. FIG. 14B is an illustration of a list 1402 representing a method of calculating coordinates of each vertex. In this case, the vertex A has tray position coordinates (coordinate values thereof are expressed as (x, y)) in the sheet discharge tray. The vertex H is determined based on the vertex A and the rendering start position height offset "s" of the sheet bundle calculated in Step S510. The coordinate values of other vertices (I to N) are determined by adding or subtracting a predetermined offset value and the sheet height h2 to or from the coordinate values of the vertex H. FIG. 14C is an illustration of a rendering command 1403 of the sheet bundle (M) 1401 at the time when the SVG is used. The shape of the sheet bundle (M) 1401 differs depending on the shape of the corresponding sheet discharge tray, but the point that the shape is determined based on the tray position coordinates, the predetermined offset value, the rendering start position height of the sheet bundle, and the height of the sheet bundle is the same.

Next, the outline of the rendering of the thumbnail image, which is performed in Step S511 and Step S514, is described with reference to FIG. 15A to FIG. 15C. In this case, similarly to FIG. 13A to FIG. 13C and FIG. 14A to FIG. 14C, description is given of a thumbnail image of the sheet bundle for which the ejection tray 323 of the large-capacity stacker 320 is designated as a discharge destination. FIG. 15A is an illustration of image data 1501 included in the job data 130 stored in the storage 122. The image data 1501 is a figure having a size and a shape that are defined by four points of A, B, C, and D. FIG. 15B is an illustration of a thumbnail image 1502 corresponding to the image data 1501. The thumbnail 1502 is an image of each of sheet parts of the first sheet and the last sheet generated in Step S511 and Step S514, and the size and the shape of the thumbnail image 1502 are defined by four points of A', B', C', and D'. FIG. 15C is an illustration of a coordinate conversion correspondence table 1503, in which coordinates of the respective vertices of the image data 1501 and the thumbnail image 1502 are listed. Symbols "m" and "n" in the respective points of A, B, C, and D are freely selected values, and are determined based on the content of the processed job corresponding to the image data 1501. The symbol "m" represents the lateral width, and the symbol "n" represents the vertical width. The coordinates of the respective points of A', B', C', and D' are the same as the coordinates of K, L, M, and N shown in FIG. 14B.

The image data 1501 is converted into the thumbnail image 1502 based on the coordinate conversion correspondence table 1503 so that coordinates are converted from A to A', from B to B', from C to C', and from D to D'. Based on the amount of change at the time of conversion, the entire image of the image data 1501 is converted into the thumbnail image 1502. In the case of the thumbnail image of the first sheet, in Step S511, the height h2 of the sheet having the coordinates of K, L, M, and N is calculated in Step S512. For example, K has the same height as H illustrated in FIG. 14A and FIG. 14B. A thumbnail image having a shape in which K, L, M, and N are positioned as vertices from the position of H is rendered. This thumbnail image corresponds to the "thumbnail image of the first sheet". In the case of the thumbnail image of the last sheet, in Step S514, the height h2 of the sheet having the coordinates of K, L, M, and N has a value calculated in Step S512. Therefore, K, L, M, and N are coordinates at an uppermost position of the sheet bundle corresponding to the designated processed job. A thumbnail image having a shape in which those points serve as vertices is rendered. This thumbnail image corresponds to the "thumbnail image of the last sheet".

Next, the outline of the thumbnail images of the first sheet and the last sheet is described. FIG. 16A and FIG. 16B are schematic diagrams for illustrating the content of the processed job. FIG. 16A is a diagram for illustrating image data 1501 of page 1 to page 20 corresponding to the "image forming job #3". In all pages, the whole one page is black, and a white page number is rendered at the center. That is, the first sheet is the sheet of page 1, and the last sheet is the sheet of page 20. FIG. 16B is a diagram for illustrating image data 1502 of page 1 to page 60 corresponding to the "image forming job #4". The whole one page is black, and a white page number is rendered at the center. The first sheet is the sheet of page 1, and the last sheet is the sheet of page 60.

Figure 17:
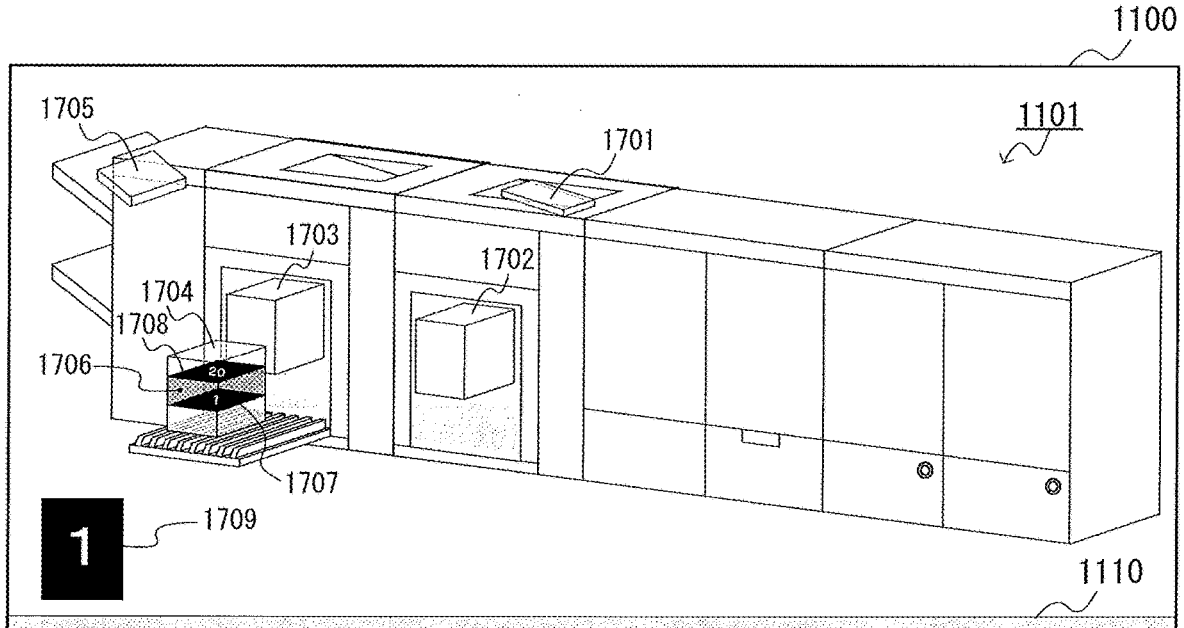
FIG. 17 is a diagram of the monitor screen obtained after the thumbnail images are rendered.

FIG. 17 is a diagram of a monitor screen 1100 obtained after the thumbnail images are rendered. In FIG. 17, illustration is given of an example in which sheets corresponding to a processed job designated in the list region 1110 are discharged to one sheet discharge tray. Sheet bundles 1701 to 1705 are images of sheet parts rendered in Step S506. In the example of FIG. 17, in the image region 1101, images of sheet parts representing the sheet bundles 1701 to 1705 are mapped and displayed at sheet stacking portions of the system configuration image, that is, positions of the sheet discharge trays on which the sheets are stacked. A sheet bundle 1706 is a sheet bundle corresponding to a processed job that is displayed in an inverted manner in the list region 1110. In the example of FIG. 17, a job (image forming job

#3) having the job ID of "00000003" is designated, and a sheet part of the sheet bundle 1706 corresponding thereto is rendered and displayed in a display mode that is different from those of the other sheet bundles 1701 to 1705.

An image 1707 is the "thumbnail image of the first sheet" rendered in Step S511. In this case, the image forming job #3 having the job ID of "00000003" is designated, and the image of page 1 in the image data 1601 of FIG. 16A is rendered. An image 1708 is the "thumbnail image of the last sheet" rendered in Step S514. In this case, the image forming job #3 having the job ID of "00000003" is designated, and the image of page 20 in the image data 1601 of FIG. 16A is rendered. An image 1709 is the thumbnail image rendered in Step S502. In this case, the image forming job #3 having the job ID of "00000003" is designated, and the thumbnail image of page 1 in the image data 1601 of FIG. 16A is displayed. The image 1709 and the image 1707 are displayed in the same display mode, and hence the operator can easily recognize the position of the sheet bundle 1704 corresponding to the designated processed job from the sheet discharge trays.

Figure 18:
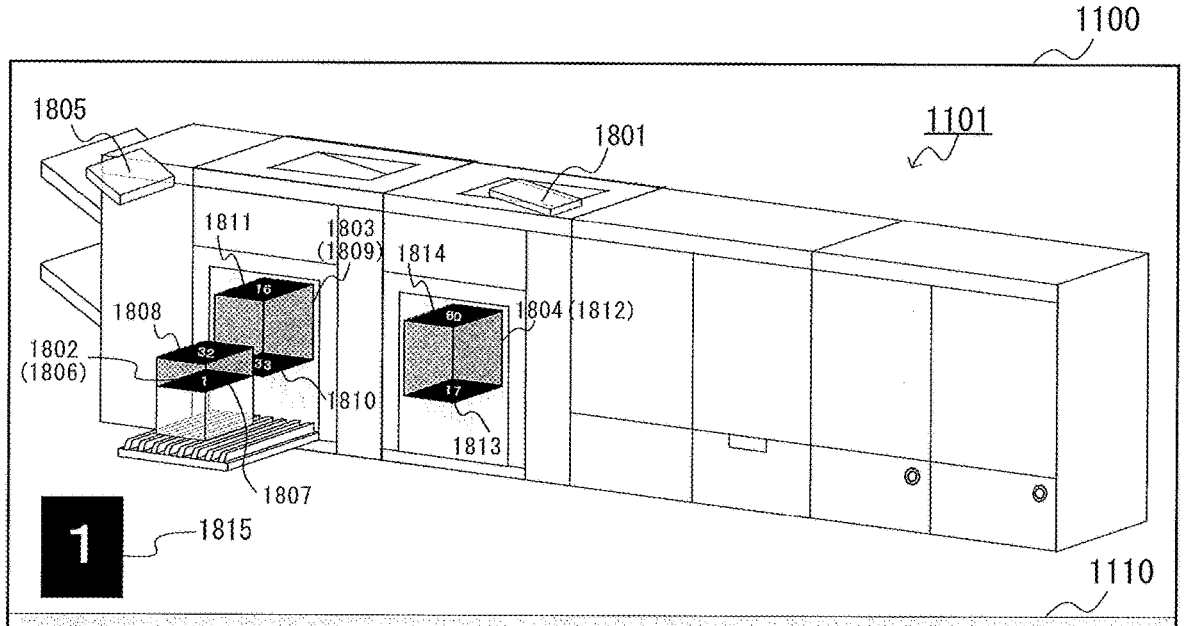
FIG. 18 is a diagram of another monitor screen obtained after the thumbnail images are rendered.

FIG. 18 is a schematic diagram for illustrating another display example of the monitor screen 1100. In FIG. 18, illustration is given of a case in which sheets for the designated processed job are discharged to a plurality of sheet discharge trays in a divided manner. Sheet bundles 1801 to 1805 are sheet bundles on respective sheet discharge trays, which are rendered in Step S506. Sheet bundle images representing those sheet bundles are mapped and displayed at sheet stacking portions of the system configuration image, that is, positions of the sheet discharge trays on which the sheets are stacked. Sheet bundles 1806, 1809, and 1812 are sheet parts of the sheet bundles rendered in Step S513. In this case, a processed job (image forming job #4) having the job ID of "00000004" is designated, and the sheet bundles 1802, 1803, and 1804 corresponding thereto are changed in display mode to the sheet bundles 1806, 1809, and 1812, respectively. The sheet bundle 1806 is a sheet bundle for which the stacking starts from the middle of the sheet bundle 1802. The sheet parts of the sheet bundles 1806, 1809, and 1812 are displayed with a display color that is different from those of the sheet bundles 1801, 1802 (part other than the sheet bundle 1806), and 1805 corresponding to other processed jobs, for example. The designated processed job is divided into a plurality of trays, and hence the display mode differs at a plurality of positions even though one processed job is designated.

The stacking is finished in the order of the sheet bundles 1806, 1809, and 1812. Images 1807, 1810, and 1813 are the "thumbnail images of the first sheet" rendered in Step S511. The image 1807 is an image of page 1, which is the first sheet of the first bundle, in the content of the image forming job (60 pages, 500 bundles) indicated by the image data 1602 of FIG. 16B. The image 1810 is the first sheet of the sheet bundle 1809. Page 33 being the next page of a sheet rendered as page 32 in an image 1808 is rendered as the "thumbnail image of the first sheet". The image 1813 is the "thumbnail image of the first sheet" of the sheet bundle 1812. The image of page 17 being the next page of a sheet rendered as page 16 in an image 1811 is rendered as the "thumbnail image of the first sheet".

Images 1808, 1811, and 1814 are the "thumbnail images of the last sheet" rendered in Step S514. The images 1808, 1811, and 1814 are rendered as last sheets of the processed job (image forming job #4) having the job ID of "00000004". In the image 1808, the image of page 32 being the last sheet of the sheet bundle image 1806 in the content of the processed job illustrated in the image data 1602 of FIG. 16B is rendered as the "thumbnail image of the last sheet". In the image 1811, the image of page 16 being the last sheet of the sheet bundle 1809 in the content of the image forming job described with the image data 1602 of FIG. 16B is rendered as the "thumbnail image of the last sheet". The image 1814 is an image of the last sheet of the last sheet bundle 1812 in the designated processed job. The image of page 60 in the content of the image forming job described with the image data 1602 of FIG. 16B is rendered as the "thumbnail image of the last sheet".

An image 1815 that is displayed as a representative in the image region 1101 is a thumbnail image of the first sheet of the designated image forming job, which is rendered in Step S502. In this case, a processed job (image forming job #4) having the job ID of "00000004" is designated, and the image of page 1 in the content of the processed job illustrated in the image data 1602 of FIG. 16B is rendered as the thumbnail image. In this manner, even when the designated processed job is divided into a plurality of sheet discharge trays, the operator can easily recognize the position of the sheet bundle corresponding to the designated processed job from the plurality of sheet discharge trays.

As described above, according to the image forming system of the first embodiment, the thumbnail images of the first sheet and the last sheet of the sheet bundle are displayed on the monitor screen, and hence the position of the sheet having the image formed thereon and corresponding to the desired image forming job can be easily identified. In this manner, the operator can refer to the page image displayed at the discharge destination to reliably collect the desired sheets having the images formed thereon even when sheets for a plurality of processed jobs are discharged to the same sheet discharge tray. In this manner, for example, in the image forming system configured to receive small-lot and high-variety orders for image formation, the positions of the sheets having the images formed thereon, which are stacked in a divided manner, can be easily identified.

Other Embodiments

In the first embodiment, a configuration example in which the information processing apparatus 100 and the image forming apparatus 101 are separate members is described, but the image forming apparatus 101 may have the function of the information processing apparatus 100. That is, the image forming apparatus 101 may include the storage 112, the display 113, and the input portion 114. In this case, the functions of generating the system configuration image and the sheet bundle image are achieved by the controller 121. That is, the controller 121 generates the system configuration image and the sheet bundle image, and displays the generated system configuration image and the generated sheet bundle image on the display 113. Further, the controller 121 may operate as a control device for updating the display of the sheet bundle image every time the detection result is acquired from the sheet presence/absence detection sensor 330 or the like.

Further, in the first embodiment, the stacking state information may be transmitted to the information processing apparatus every time one sheet bundle image is formed, but this is merely an example. For example, the stacking state information may be transmitted each time a predetermined time period elapses.

In the first embodiment, the entire stacking state information is transmitted to the information processing apparatus, but only the difference from the previously-transmitted stacking state information may be transmitted. Further, in the first embodiment, description is given of an example in which one processed job is selected in the list region 1110, but the present disclosure is applicable even when a plurality of processed jobs can be simultaneously selected. Further, in the first embodiment, the coefficient P is used to calculate the height of the sheet bundle, but the value of the coefficient P may also be changed in accordance with the information on the thickness of the sheet so that the height of the sheet figure is also changed in accordance therewith. Further, in the first embodiment, the first sheet and the last sheet of the designated job are displayed at the sheet discharge positions with the same shape. However, the first sheet and the last sheet may be displayed at different positions in order to show large and conspicuous sheet bundle images, and the display of the first sheet and the last sheet may be associated to the sheet discharge positions with an arrow or the like.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-101138, filed May 22, 2017, which is hereby incorporated by reference herein in its entirety.

What is claimed is:

1. A control apparatus for controlling a system having an image forming apparatus to form an image onto a sheet based on an image forming job, and a sheet discharge apparatus to discharge the sheet to a sheet stacking tray, the control apparatus comprising:

a processor; and a memory storing a program which, when executed by the processor, causes the control apparatus to:

receive configuration information of the system and generate a system configuration image based on the configuration information, receive stacking state information including a stacking amount of sheets stacked as a sheet bundle, on the sheet stacking tray and generate a sheet bundle image representing the sheets stacked on the sheet stacking tray based on the stacking state information, display, on a display, a screen in which the sheet bundle image is mapped at a sheet stacking portion, corresponding to the sheet stacking tray, of the system configuration image, receive job identification information of an image forming job of sheets to be picked up, wherein the image forming job which is identified by the job identification information is a job selected from an execution history list of a plurality of image forming jobs which have been executed and which have not yet been removed from the sheet discharge apparatus, and generate a first thumbnail image and a last thumbnail image, wherein the first thumbnail image is a thumbnail image of an image which is formed on a first discharged sheet of the image forming job selected from the execution history list and the last thumbnail image is a thumbnail image of an image which is formed on a last discharged sheet of the image forming job selected from the execution history list, wherein the processor simultaneously displays, on the display, a first sheet bundle image of the image forming job selected from the execution history list, a second sheet bundle image corresponding to an image forming job which is not selected from the execution history list, the first thumbnail image, and the last thumbnail image, and wherein the processor displays the first sheet bundle image and the second sheet bundle image in different display forms.

2. The control apparatus according to claim 1, wherein executing the program causes the control apparatus to display a thumbnail image at a corresponding sheet part of the sheet bundle image in the system configuration image.

3. The control apparatus according to claim 1, wherein executing the program causes the control apparatus to display, together with the sheet bundle image, the last thumbnail image of the last discharged sheet of the sheet bundle at a corresponding sheet part.

4. The control apparatus according to claim 3, wherein executing the program causes the control apparatus to display an image that allows identification of each of the first discharged sheet and the last discharged sheet as a thumbnail image representing content of the image to be formed on the sheet.

5. The control apparatus according to claim 4, further comprising a job input portion for input of at least one image forming job, wherein executing the program causes the control apparatus to form the image, to be formed on the sheet, onto the sheet for each input image forming job, wherein the sheet discharge apparatus is configured to stack the sheet bundle for each image forming job, and wherein executing the program causes the control apparatus to store, as stored images, an image formed on the first discharged sheet and an image formed on the last discharged sheet of the sheet bundle, and to convert each of the stored images into a thumbnail image to display the thumbnail image, obtained by conversion, at a corresponding sheet part.

6. The control apparatus according to claim 5, wherein, in a case where a plurality of sheet bundles are formed by executing one image forming job, executing the program causes the control apparatus to display a thumbnail image for each of the plurality of sheet bundles.

7. The control apparatus according to claim 6, further comprising a list display configured to display can extracted list in which an image forming job for which discharge of the sheet having the image formed thereon is finished is extracted as a processed job, wherein the control apparatus is capable of displaying the sheet bundle image accompanied with the thumbnail image of the displayed sheet bundle image in an order of the extracted list.

8. The control apparatus according to claim 7, further comprising a designation input portion for input of designation of any processed job through the extracted list, wherein executing the program causes the control apparatus to display the sheet bundle image corresponding to the designated any processed job.

9. The control apparatus according to claim 8, wherein the extracted list display is configured to display, in an emphasized manner, the designated any processed job corresponding to the displayed sheet bundle image in the extracted list.

10. The control apparatus according to claim 9, wherein executing the program causes the control apparatus to display the sheet bundle image corresponding to the designated any processed job processed job displayed in the emphasized manner.

11. A method for a control apparatus for controlling a system having an image forming apparatus to form an image onto a sheet based on an image forming job, and a sheet discharge apparatus to discharge the sheet to a sheet stacking tray, the method comprising:

receiving configuration information of the system and generating a system configuration image based on the configuration information;

receiving stacking state information including a stacking amount of sheets stacked, as a sheet bundle, on the sheet stacking tray and generating a sheet bundle image representing the sheets stacked on the sheet stacking tray based on the stacking state information;

displaying, on a display, a screen in which the sheet bundle image is mapped at a sheet stacking portion, corresponding to the sheet stacking tray, of the system configuration image;

receiving job identification information of an image forming job of sheets to be picked up, wherein the image forming job which is identified by the job identification information is a job selected from an execution history list of a plurality of image forming jobs which have been executed and which have not yet been removed from the sheet discharge apparatus; and generating a first thumbnail image and a last thumbnail image, wherein the first thumbnail image is a thumbnail image of an image which is formed on a first discharged sheet of the image forming job selected from the execution history list and the last thumbnail image is a thumbnail image of an image which is formed on a last discharged sheet of the image forming job selected from the execution history list, wherein displaying includes simultaneously displaying, on the display, a first sheet bundle image of the image forming job selected from the execution history list, a second sheet bundle image corresponding to an image forming job which is not selected from the execution history list, the first thumbnail image, and the last thumbnail image, and wherein displaying includes displaying the first sheet bundle image and the second sheet bundle image in different display forms.

12. A non-transitory computer-readable storage medium storing a program to cause a control apparatus to perform a method for a control apparatus for controlling a system having an image forming apparatus to form an image onto a sheet based on an image forming job, and a sheet discharge apparatus to discharge the sheet to a sheet stacking tray, the method comprising:

receiving configuration information of the system and generating a system configuration image based on the configuration information;

receiving stacking state information including a stacking amount of sheets stacked, as a sheet bundle, on the sheet stacking tray and generating a sheet bundle image representing the sheets stacked on the sheet stacking tray based on the stacking state information;

displaying, on a display, a screen in which the sheet bundle image is mapped at a sheet stacking portion, corresponding to the sheet stacking tray, of the system configuration image;

receiving job identification information of an image forming job of sheets to be picked up, wherein the image forming job which is identified by the job identification information is a job selected from an execution history list of a plurality of image forming jobs which have been executed and which have not yet been removed from the sheet discharge apparatus; and generating a first thumbnail image and a last thumbnail image, wherein the first thumbnail image is a thumbnail image of an image which is formed on a first discharged sheet of the image forming job selected from the execution history list and the last thumbnail image is a thumbnail image of an image which is formed on a last discharged sheet of the image forming job selected from the execution history list, wherein displaying includes simultaneously displaying, on the display, a first sheet bundle image of the image forming job selected from the execution history list, a second sheet bundle image corresponding to an image forming job which is not selected from the execution history list, the first thumbnail image, and the last thumbnail image, and wherein displaying includes displaying the first sheet bundle image and the second sheet bundle image in different display forms.

* * * * *